US009157205B1

(12) United States Patent
Novotny et al.

(10) Patent No.: US 9,157,205 B1
(45) Date of Patent: Oct. 13, 2015

(54) ABOVE GROUND CONTAINMENT SYSTEMS AND METHODS FOR ASSEMBLING SAME

(71) Applicant: TETRA Technologies, Inc., The Woodlands, TX (US)

(72) Inventors: John Novotny, The Woodlands, TX (US); Yannick Harvey, The Woodlands, TX (US); Dustin Downing, The Woodlands, TX (US); Robert Davis, Bellefonte, PA (US); Mark Ritchey, State College, PA (US)

(73) Assignee: TETRA Technologies, Inc., The Woodlands, TX (US)

( * ) Notice: Subject to any disclaimer, the term of this patent is extended or adjusted under 35 U.S.C. 154(b) by 0 days.

(21) Appl. No.: 13/845,221

(22) Filed: Mar. 18, 2013

Related U.S. Application Data

(63) Continuation-in-part of application No. 13/480,469, filed on May 24, 2012, now Pat. No. 8,640,901.

(60) Provisional application No. 61/489,336, filed on May 24, 2011, provisional application No. 61/651,546, filed on May 24, 2012.

(51) Int. Cl.
*B65D 88/12* (2006.01)
*B65D 90/04* (2006.01)
*B65D 25/16* (2006.01)
*E02B 7/20* (2006.01)

(52) U.S. Cl.
CPC . *E02B 7/20* (2013.01); *B65D 88/12* (2013.01); *B65D 90/047* (2013.01); *B65D 25/16* (2013.01)

(58) Field of Classification Search
CPC ..... B65D 88/12; B65D 88/02; B65D 88/123; B65D 90/047; B65D 90/046; B65D 90/04; B65D 25/16; B65D 25/14; E02B 7/20
USPC ..... 220/565, 567, 567.1, 1.5, 615, 610, 220/638, 628, 1.6
IPC ..... B65D 90/04, 25/16, 25/14
See application file for complete search history.

(56) References Cited

U.S. PATENT DOCUMENTS 6,079,904 A * 6/2000 Trisl ..... 405/107

* cited by examiner

*Primary Examiner* — Robert J Hicks
(74) *Attorney, Agent, or Firm* — Brett A. North; Garvey, Smith, Nehrbass & North, LLC

(57) ABSTRACT

A water containment apparatus includes a straight strut arrangement comprising a plurality of straight strut assemblies forming an alternating v-shape and inverted v-shape pattern; and a curved strut arrangement comprising a plurality of corner strut assemblies forming a desired curvature and connecting two straight strut arrangements to form a closed loop water containment system.

30 Claims, 33 Drawing Sheets

TOP VIEW

SIDE VIEW

ABOVE GROUND CONTAINMENT SYSTEMS AND METHODS FOR ASSEMBLING SAME

CROSS-REFERENCE TO RELATED APPLICATIONS

This is a continuation-in-part of U.S. patent application Ser. No. 13/480,469, filed on May 24, 2012, which application was a non provisional of both U.S. provisional patent application No. 61/489,336, filed May 24, 2011, and U.S. provisional patent application No. 61/651,546, filed on May 24, 2012. The entire contents of each and every one of these applications are incorporated herein by reference and priority of/to each of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates generally to portable dam assemblies and method for assembling same.

2. General Background of the Invention

The present disclosure is broadly concerned with cofferdams for use in temporarily holding back a body of water when performing construction, repairs or bank stabilization in the bed of a river or a lake or any body of water, and also on dry land for flood protection. Such cofferdams are typically constructed of a framework of individual frame structures placed in adjacent alignment along a portion of the body of water which is to be held back. A flexible waterproof fabric is secured along the framework for holding back the water so that work may be performed in the area behind the framework. Given the substantial hydrostatic pressure created in holding back a large volume of water, the frame structures must be extremely sturdy. They are typically formed of steel or iron stock and have a triangular configuration which is best suited for bearing the pressure load. These cofferdams are constructed so that they may be quickly erected and disassembled. Portable dams of this type are well known to those having skill in the art.

Because of the need for quick assembly and disassembly of the portable dam, it is critical that the individual frame structures be configured not only for ease in erecting, bur also ease and efficiency in transporting. Frequently, portable dams must be erected as quickly as possible, especially during emergency conditions, so it is important that the individual frame structures be connected in a manner to permit this. Current modes of connection include clamps which must be bolted directly to the frame structures, and stakes which must be driven into the ground as well as bolted to the frame structure. A substantial amount of time is invested in bolting on these clamps. Additionally, because of the large number of individual frame structures required in constructing a length of cofferdam, it is desirable to maximize the number of frame structures that can be stacked on a truck or trailer that transports the frame structures. Generally, individual frame structures are integral pieces and are fixed in their triangular configuration, which is not particularly conducive to efficient stacking. Accordingly, several truck load trips must usually be made to bring a sufficient number of frame structures to the cofferdam construction site.

A further problem faced by erectors of portable cofferdams lies in being able to place the framework down in a stable position in the bed of the body of water to be held back. There is a tremendous pressure placed on the frame structures from the body of water that is held back. Frequently, the river bed is uneven or rocky, which crates stability problems by causing the continuity of the framework to be disrupted. Weak points in the framework caused by such a disruption could allow the cofferdam to collapse, leading to disastrous results.

Accordingly, there is a need in the art for frame structures for use in a portable dam that are adapted for quick assembly and disassembly in erecting the dam with minimal amount of set up time or expenditure of manpower. Additionally, it is desirable that such frame structures be configured for efficient transportation and storage.

Further, there is a need for frame structures of a portable dam that provide stabilization for supporting large hydrostatic pressures and that are adapted to adjust to uneven terrain on which the dam is erected so that stability of the dam can be maintained.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a method and apparatus for temporary above ground water containment.

In various embodiments is provided an above ground containment method and apparatus adapted for quick assembly and disassembly in erecting the structure with minimal amount of set up time or expenditure of manpower.

In various embodiments is provided an above ground containment method and apparatus including a plurality of frame structures configured for efficient transportation and storage.

In various embodiments is provided an above ground containment method and apparatus providing provide stabilization for supporting large hydrostatic pressures and adapted to adjust to uneven terrain on which the containment structure is erected so that stability of the structure can be maintained.

In one embodiment is provided a method of constructing a portable reservoir, comprising the steps of: placing a plurality of base plates on an underlying support surface, said plurality of base plates including inner base plates and outer base plates; maintaining a lateral spacing of each base plate relative to the other base plates with connector bars that each have end portions; forming a removable connection with each connector bar end portion and a said base plate; wherein steps "a", "b" and "c" define a reservoir footprint; erecting a straight strut arrangement that comprises a plurality of straight strut assemblies, each straight strut assembly including a plurality of inner base plates that enable interface of each straight strut assembly with a ground surface, a plurality of inclined beams, each having a lower surface that is attached to and bears upon a said inner base plate, a plurality of outer base plates, and intermediate beams that each extend between an outer base plate and an inclined beam, each intermediate beam connecting to the inclined beam at a position in between the ends of the inclined beam, the inclined beams forming an alternating v-shaped and inverted v-shaped pattern; erecting a curved strut arrangement comprising a plurality of corner strut assemblies forming a desired curvature and connecting two straight strut arrangements to form a closed loop water containment system; and maintaining a lateral spacing between the inclined beams with lateral bracing.

In various embodiments each connector bar can connect to a plate with a pin and slot connection. In various embodiments each plate can have projections and each connector bar have slotted end portions, with the method further comprising the step of engaging a one of the projections with one of the slots. In various embodiments the method further comprises the step of connecting an upper connector between two adjacent beams at upper end portions of the beams.

In one embodiment is provided a method of constructing a temporary liquid reservoir, comprising the steps of: placing a plurality of base plates on an underlying support surface, the plurality of base plates including inner base plates and outer base plates; maintaining a lateral spacing of each base plate relative to the other base plates with connector bars that each have end portions; forming a removable connection with each connector bar end portion and a the base plate; wherein these listing steps define a reservoir footprint; erecting a plurality of frame structures supporting a flexible web liner, each of the frame structures including multiple inclined beams, at least one brace beam, and a the base plate; wherein during the erecting step the inclined and brace beams are removably connectable to each other in an erected position to form the frame structure, the support beam and the at least one brace beam of the erected frame structure lying in a common plane, the frame structure being collapsible between said erected position and a collapsed position; connecting each base plate to a bottom of said frame structure, said base plates being adapted for connection at any position along said bottom of said frame structure, each said base plate being adapted to support said frame structure on a supporting surface.

In various embodiments each connector bar can connect to a plate with a pin and slot connection. In various embodiments each plate can have projections and each connector bar have slotted end portions, with the method further comprising the step of engaging a one of the projections with one of the slots. In various embodiments the method further comprises the step of connecting an upper connector between two adjacent beams at upper end portions of the beams.

The drawings constitute a part of this specification and include exemplary embodiments to the invention, which may be embodied in various forms.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

the preferred embodiment of the apparatus of the present invention.

Figure 17:
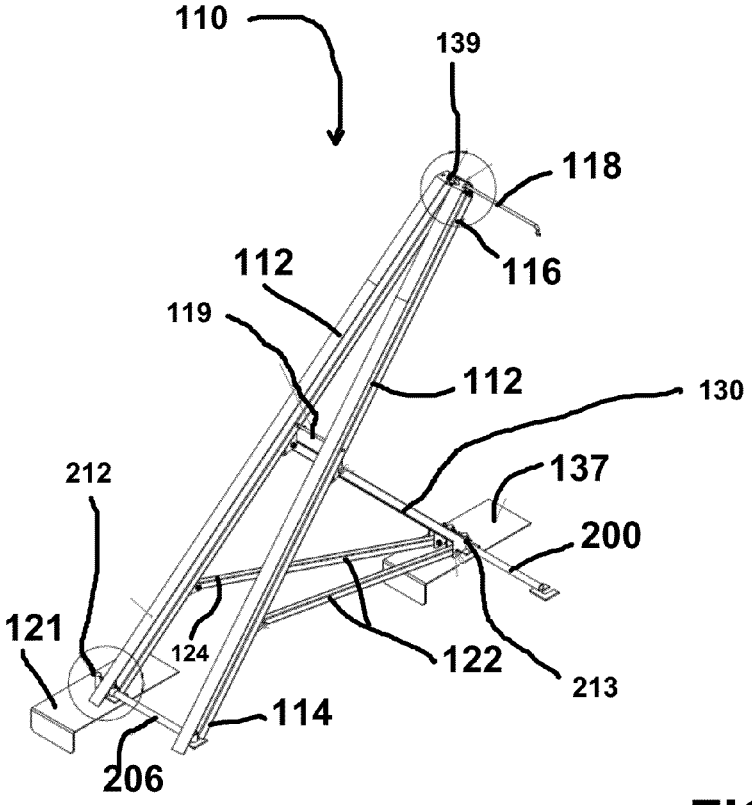
FIG. 17 is a front perspective fragmentary view of an alternative straight strut assembly in accordance with various aspects of the disclosure.
Figure 18:
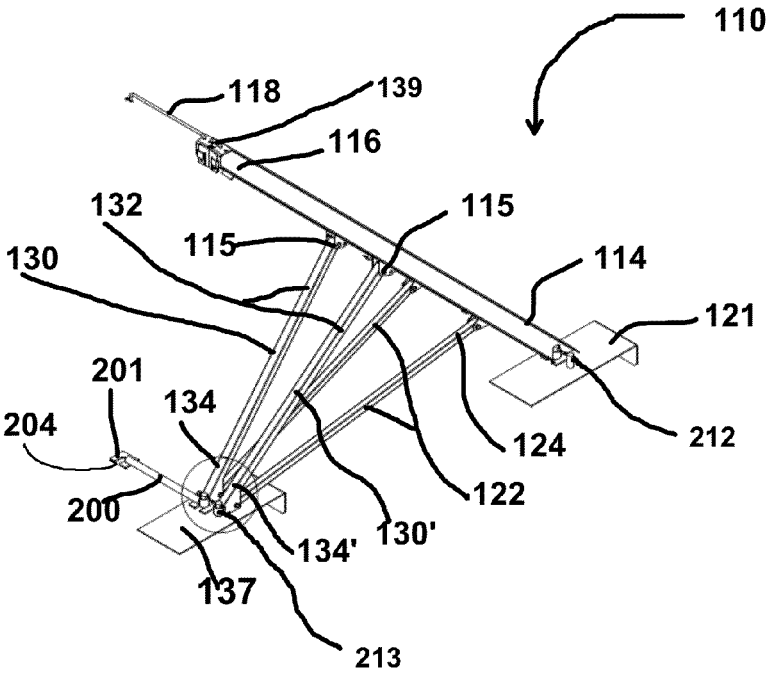

FIG. 18 is a side perspective fragmentary view of the alternative straight strut assembly of FIG. 17.

Figure 19:
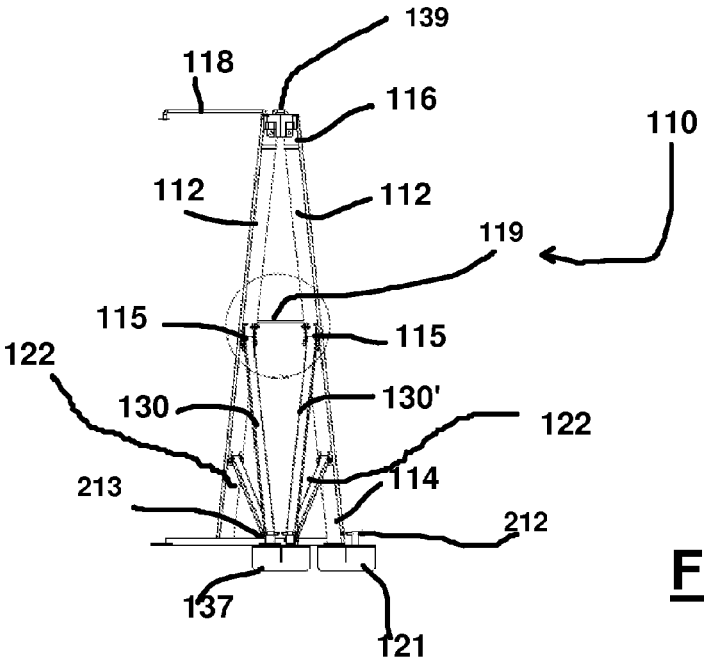

FIG. 19 is a rear fragmentary view of the alternative straight strut assembly of FIG. 17.

Figure 20:
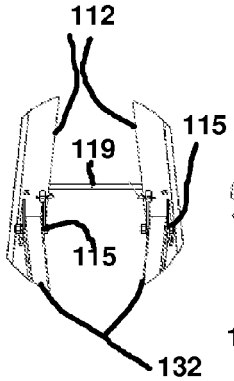

FIG. 20 is an enlarged rear view of the connection between the upper support members and strut members of the strut assembly of FIG. 19.

Figure 21:
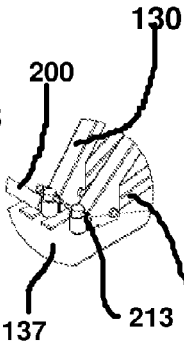

FIG. 21 is an enlarged perspective view of the lower connection between the rear support plate, the upper and lower support members, and horizontally extending links for the strut assembly of FIG. 19.

Figure 22:
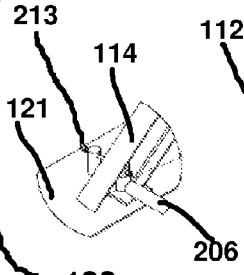

FIG. 22 is an enlarged perspective view of the lower connection between the front support plate, the strut member, and horizontally extending links for the strut assembly of FIG. 19.

Figure 23:
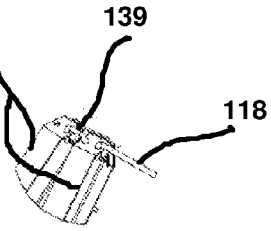

FIG. 23 is an enlarged perspective view of the connections strut members using coupling members.

Figure 24:
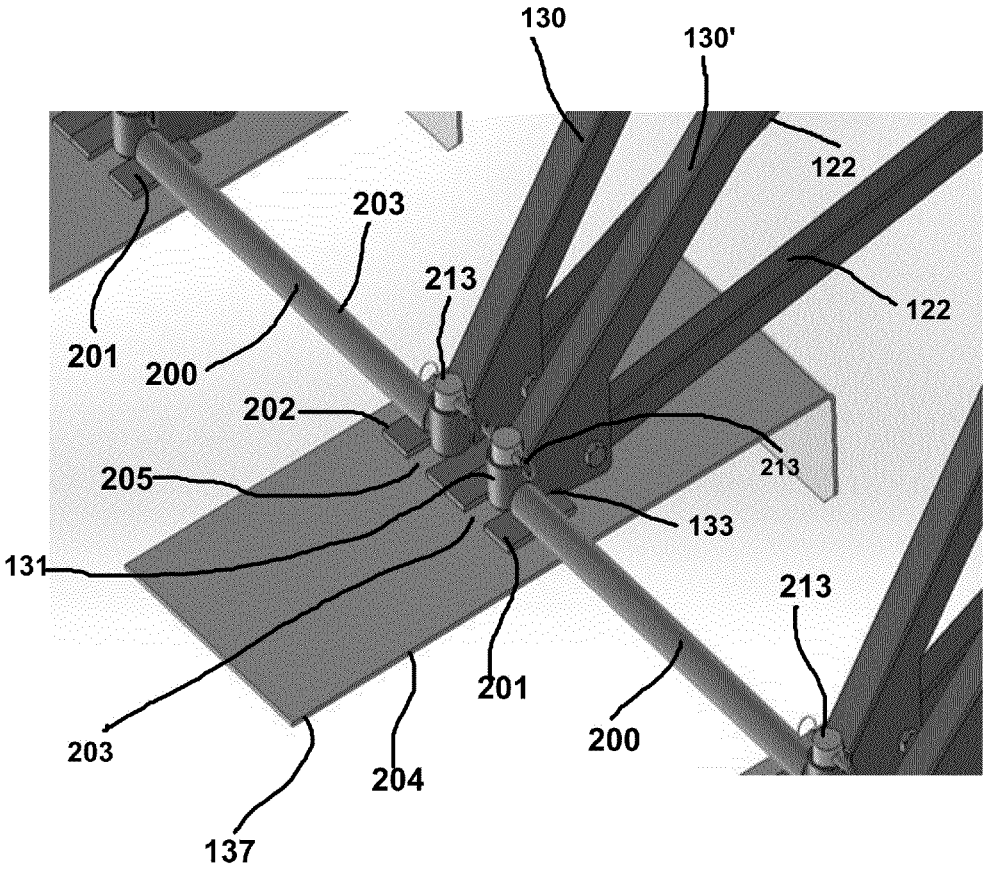

FIG. 24 is an enlarged perspective view of the lower connection between the rear support plate, the upper and lower support members, and horizontally extending links for the strut assembly of FIG. 19.

Figure 25:
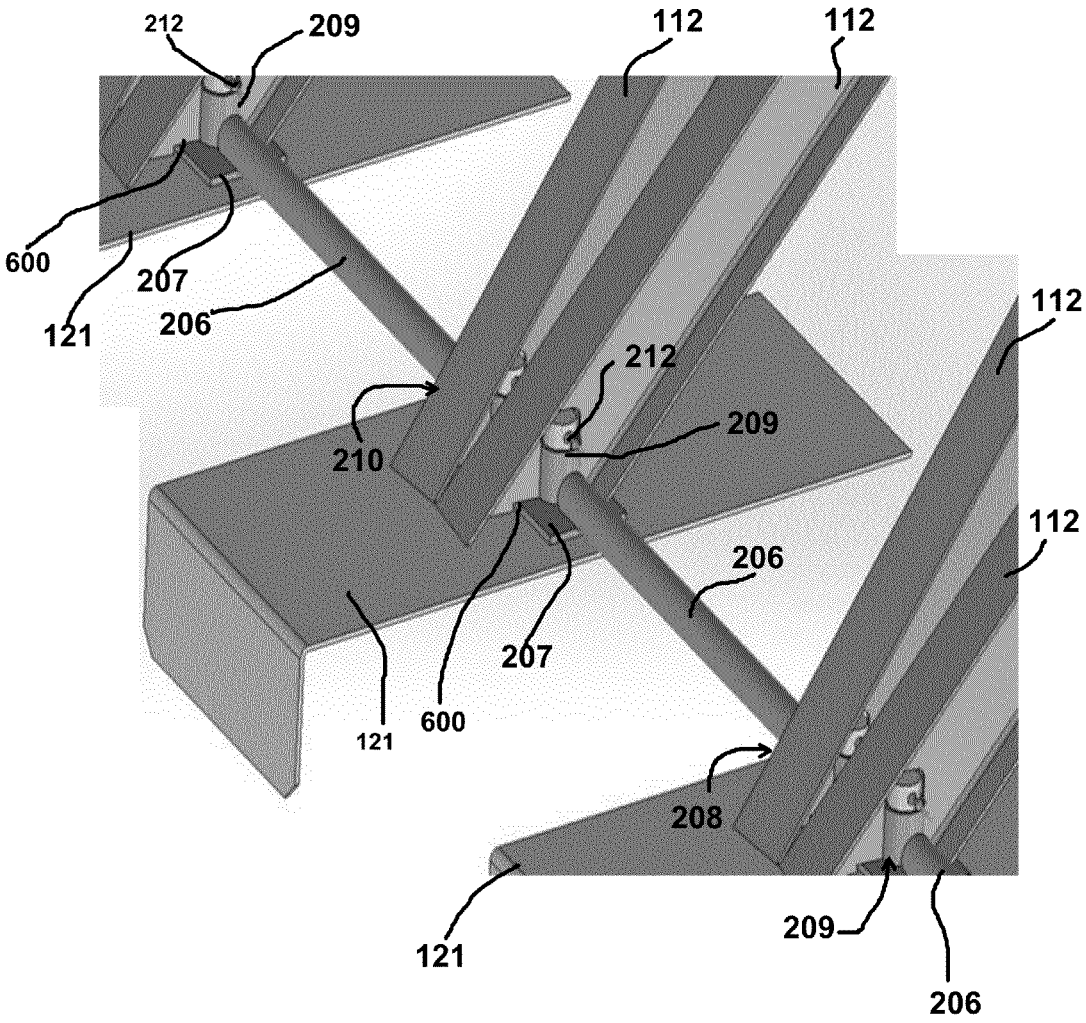

FIG. 25 is an enlarged perspective view of the lower connection between the front support plate, the strut member, and horizontally extending links for the strut assembly of FIG. 19.

Figure 26:
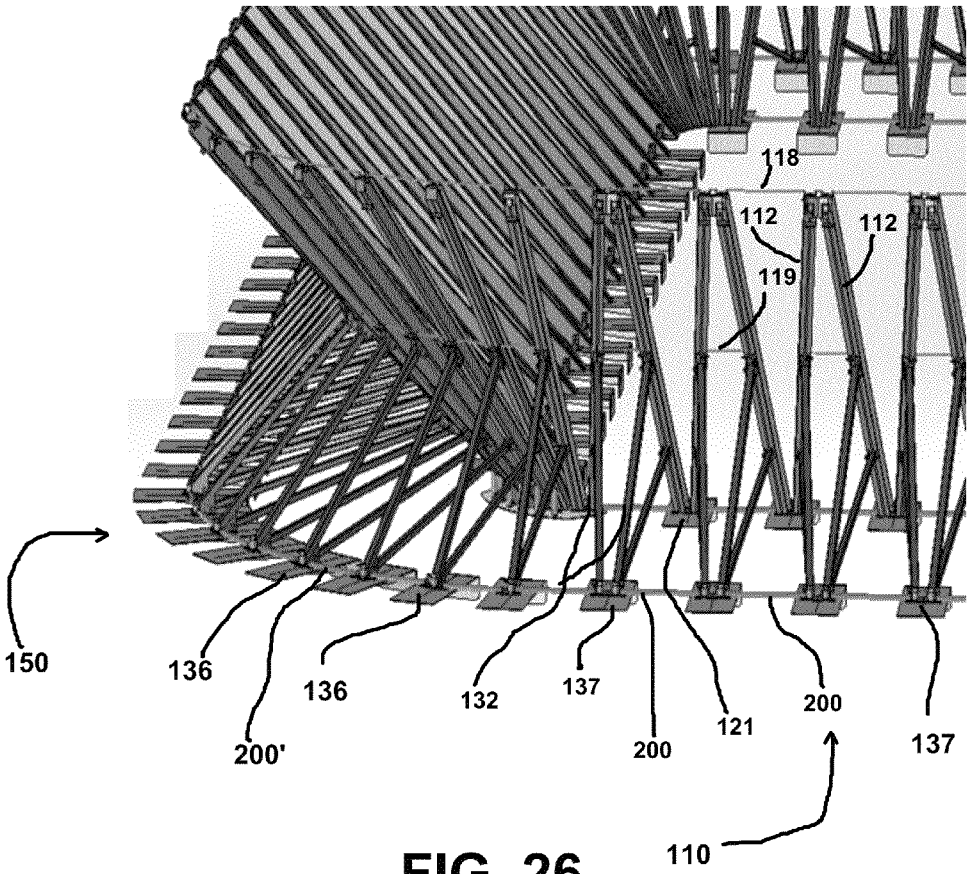

FIG. 26 is a rear perspective view of a straight strut assembly transitioning to a corner strut assembly.

Figure 27:
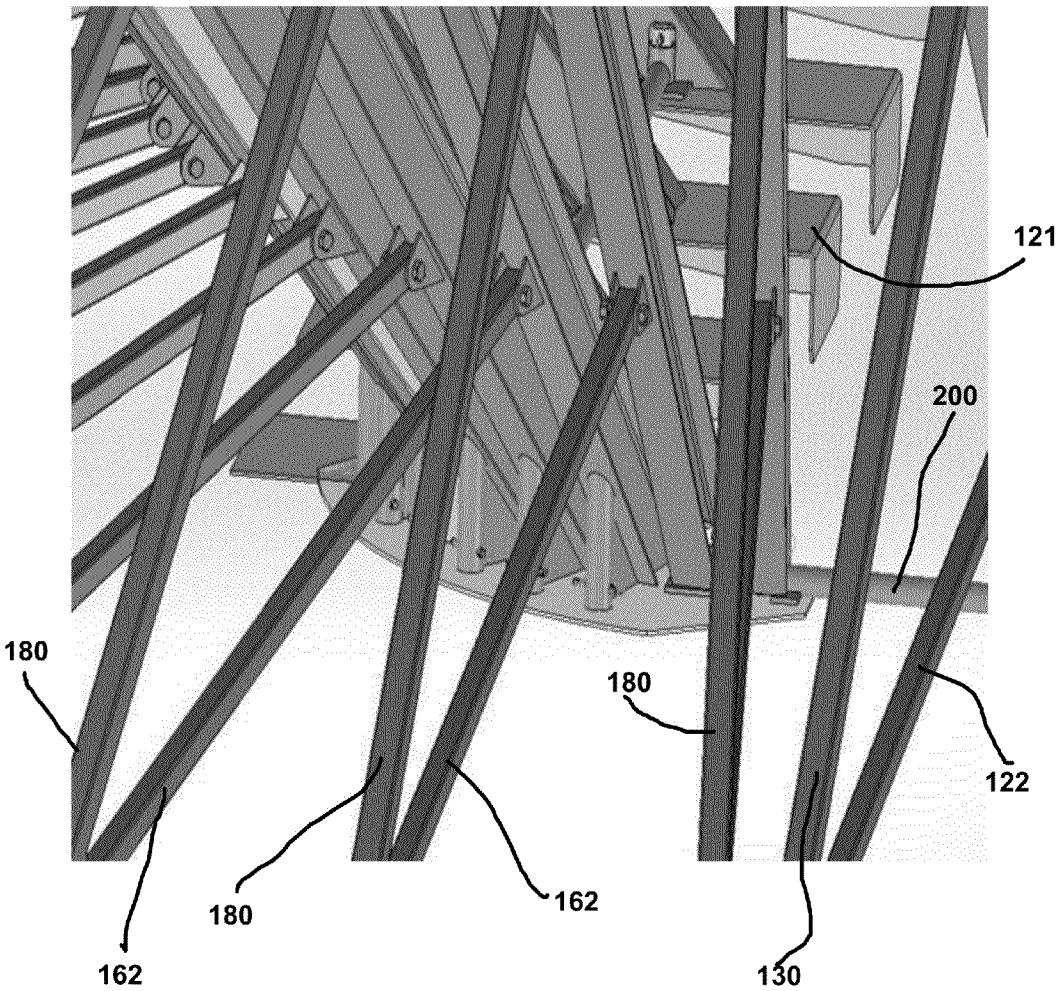

FIG. 27 is an enlarged rear perspective view of the transition shown in FIG. 26.

Figure 28:
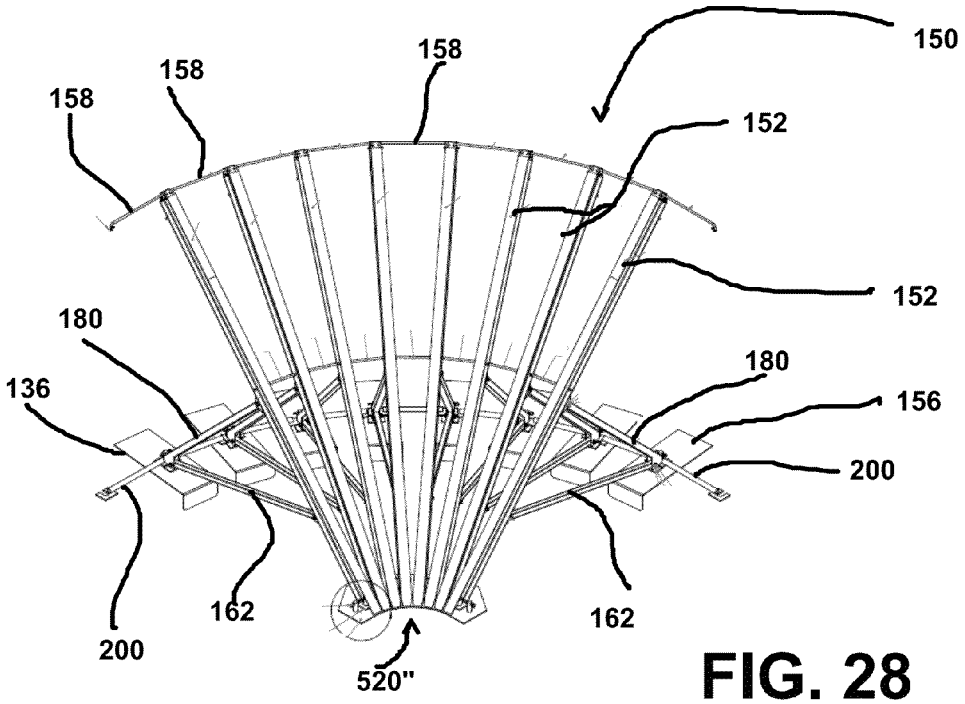

FIG. 28 is a front perspective view of a preferred corner strut assembly in accordance with various aspects of the disclosure.

Figure 29:
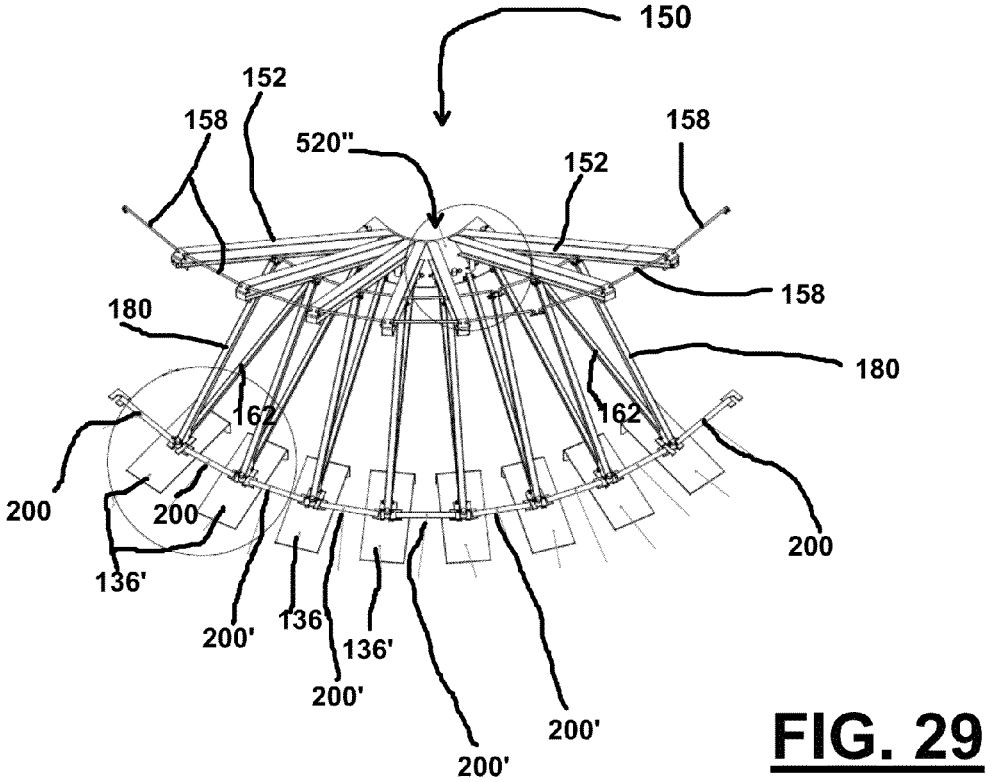

FIG. 29 is a rear perspective view of the corner strut assembly of FIG. 28.

Figure 30:
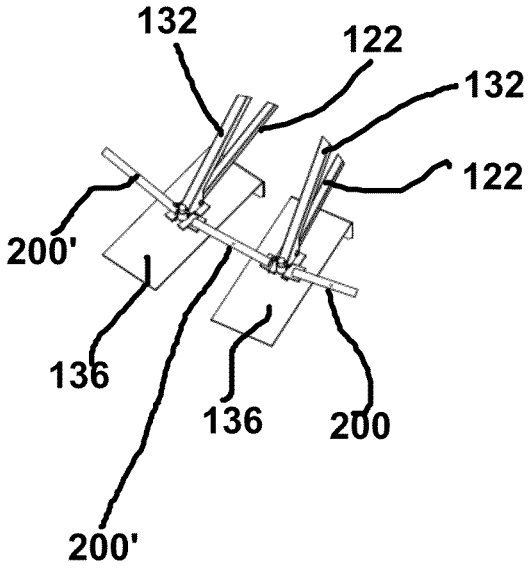

FIG. 30 is an enlarged rear perspective view of the lower connection between the rear support plate, the upper and lower support members, and horizontally extending links for the corner strut assembly of FIG. 28.

Figure 31:
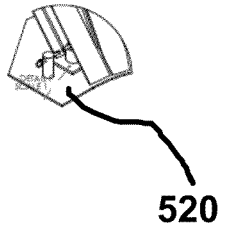

FIG. 31 is an enlarged perspective view of the lower connection between the front support plate and corner strut members, with a pin member exposed for better viewing, for the corner strut assembly of FIG. 28.

Figure 32:
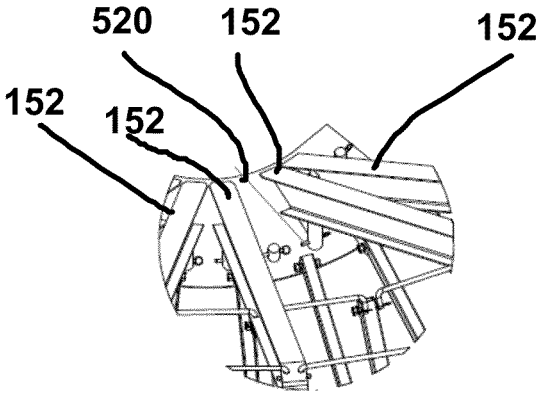

FIG. 32 is an enlarged perspective view of the lower connection between the front support plate and corner strut members for the corner strut assembly of FIG. 28.

Figure 33:
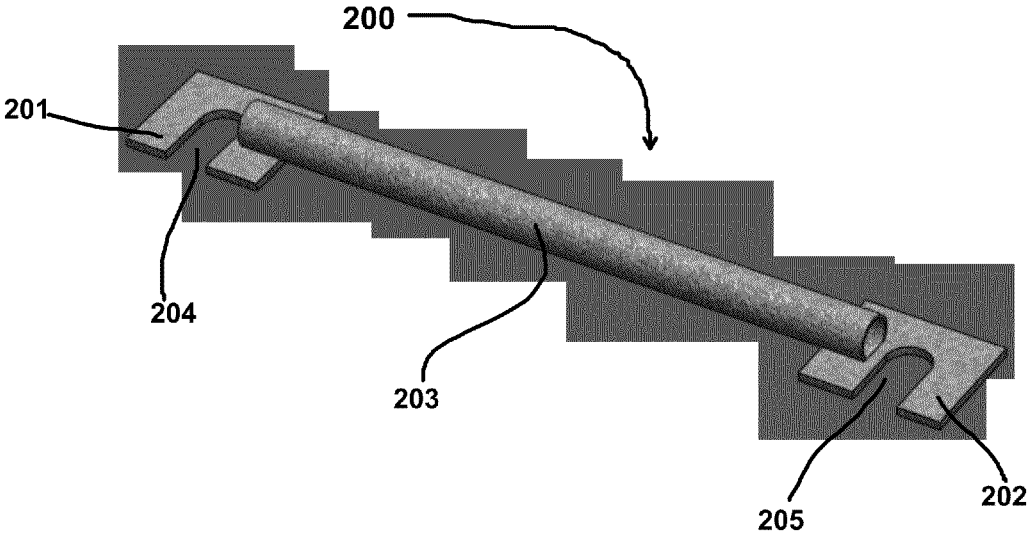

FIG. 33 is a perspective view of a horizontally extending link which can be used in the straight strut assembly of FIG. 19.

Figure 34:
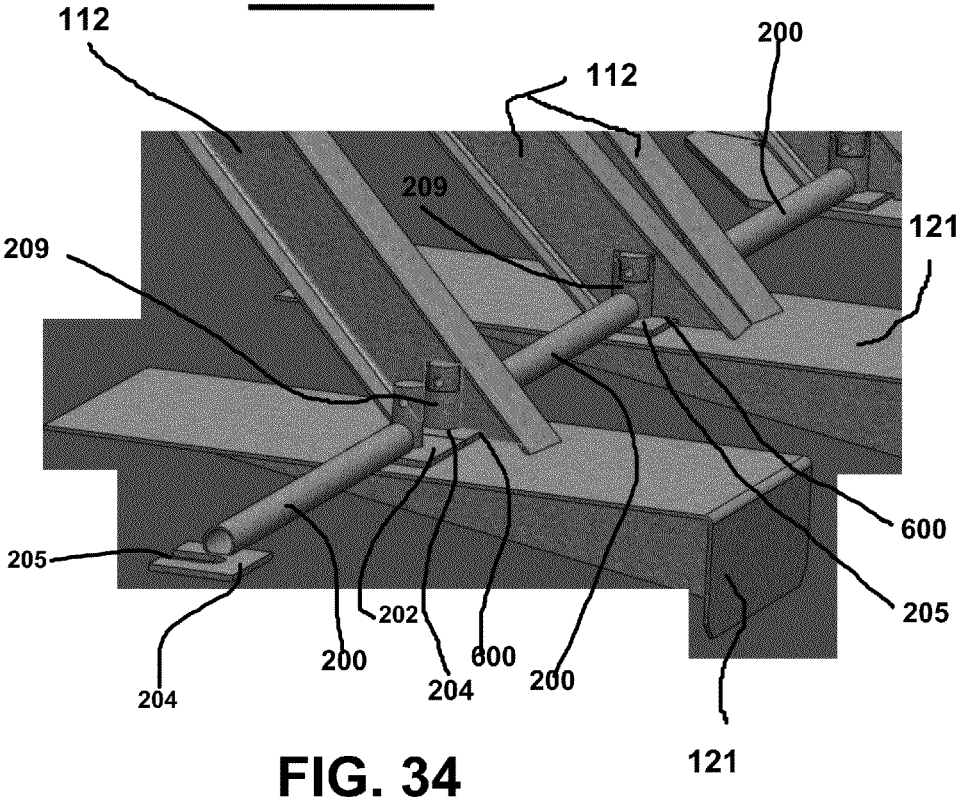

FIG. 34 is an enlarged perspective view showing lower connections between front support plates, strut members, and horizontally extending links for the straight strut assembly of FIG. 19.

Figure 35:
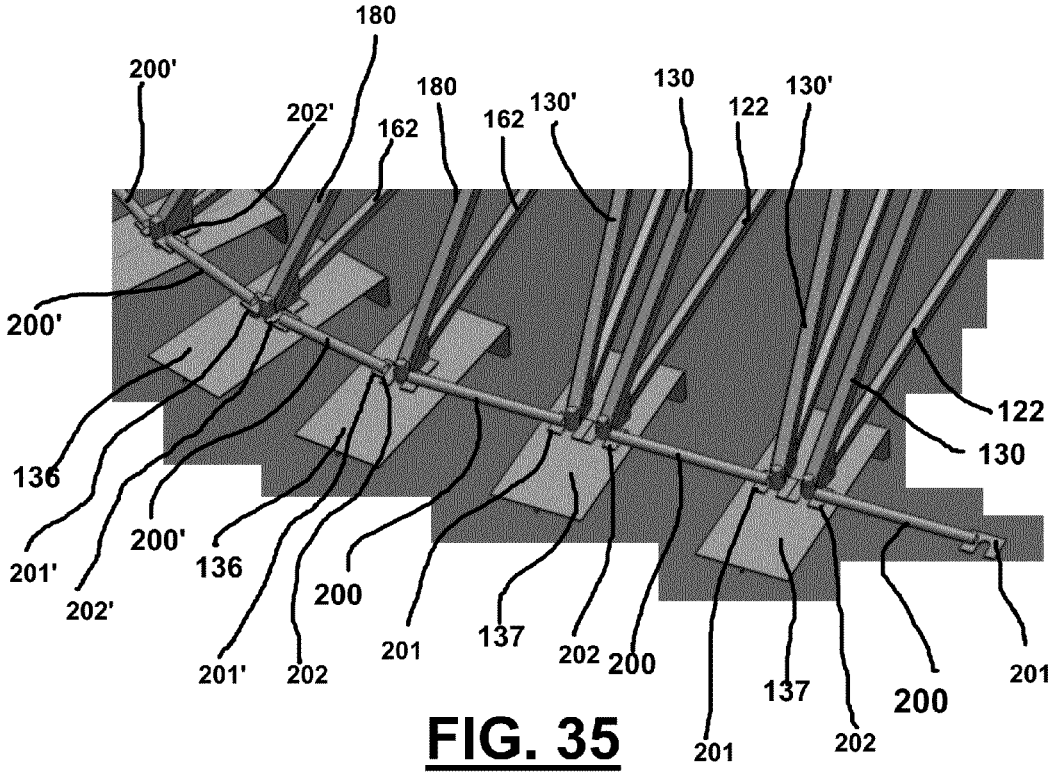

FIG. 35 is an enlarged rear perspective view of a straight strut assembly transitioning to a corner strut assembly illustrating both the lower connections between the rear support plates, the upper and lower support members, and horizontally extending links for the straight strut assembly of FIG. 19, along with the lower connections between the rear support plates, the upper and lower support members, and horizontally extending links for the corner strut assembly of FIG. 28.

Figure 36:
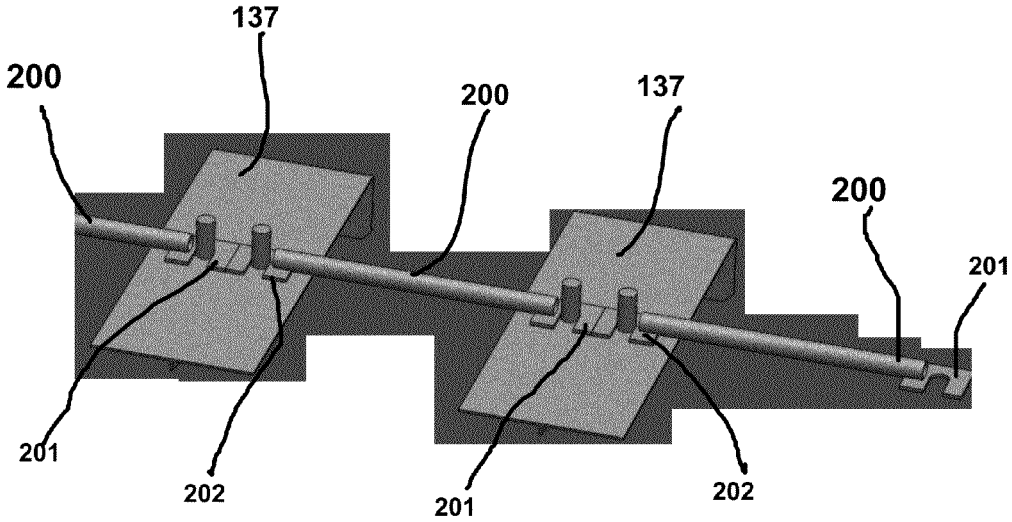

FIG. 36 is an enlarged perspective view of the connections made between rear support plates and horizontally extending links for the straight strut assembly of FIG. 19.

Figure 37:
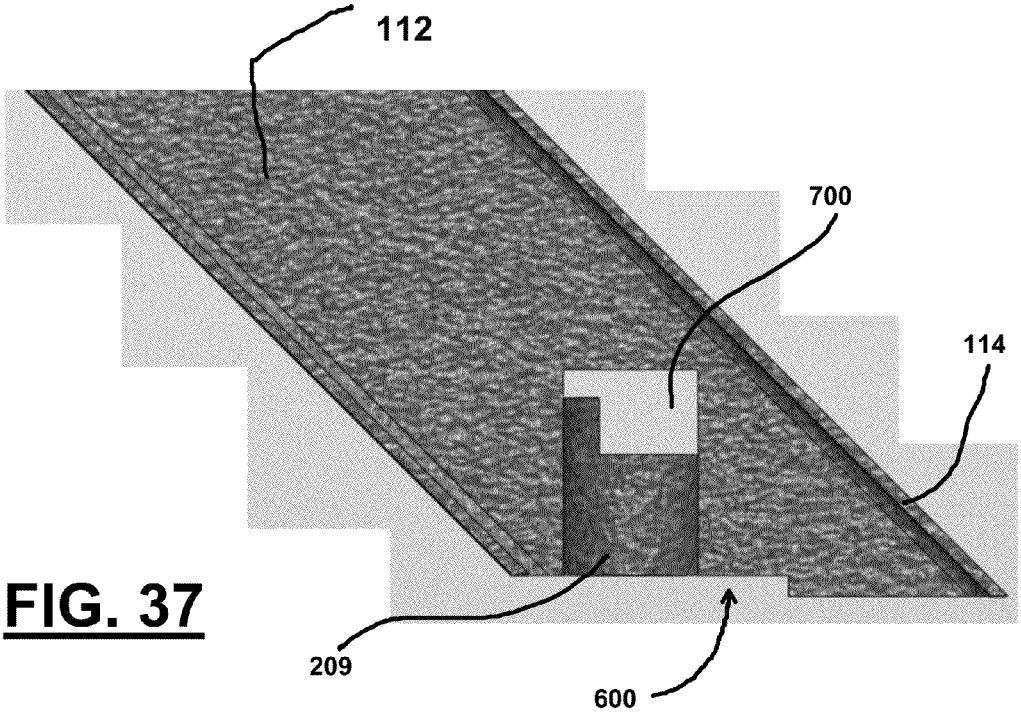

FIG. 37 is a side view of a exemplary strut member.

Figure 38:
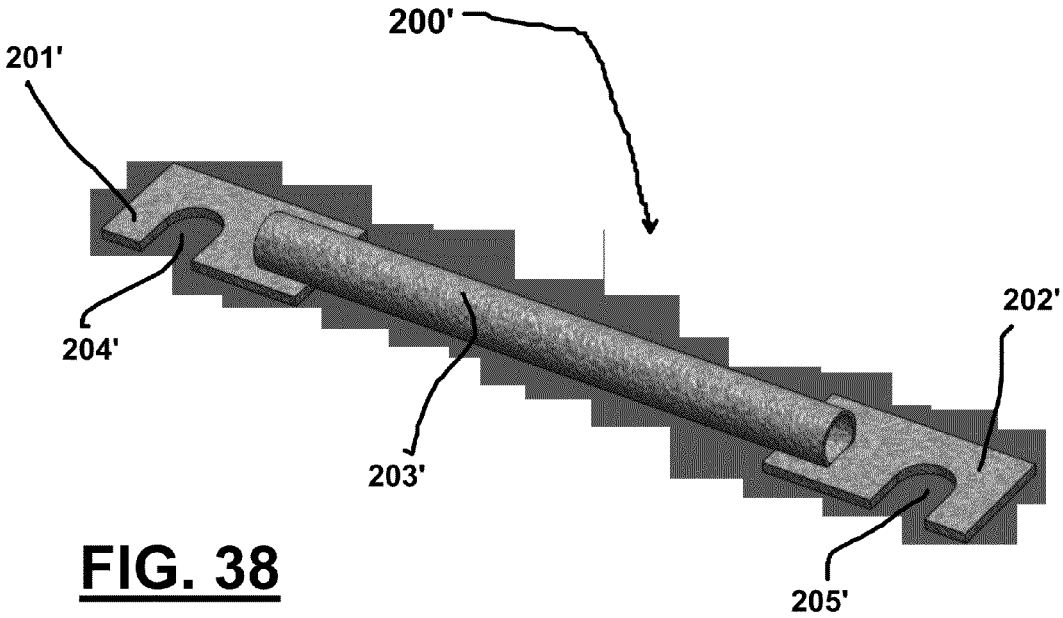

FIG. 38 is a perspective view of a horizontally extending link which can be used in the corner strut assembly of FIG. 28.

Figure 39:
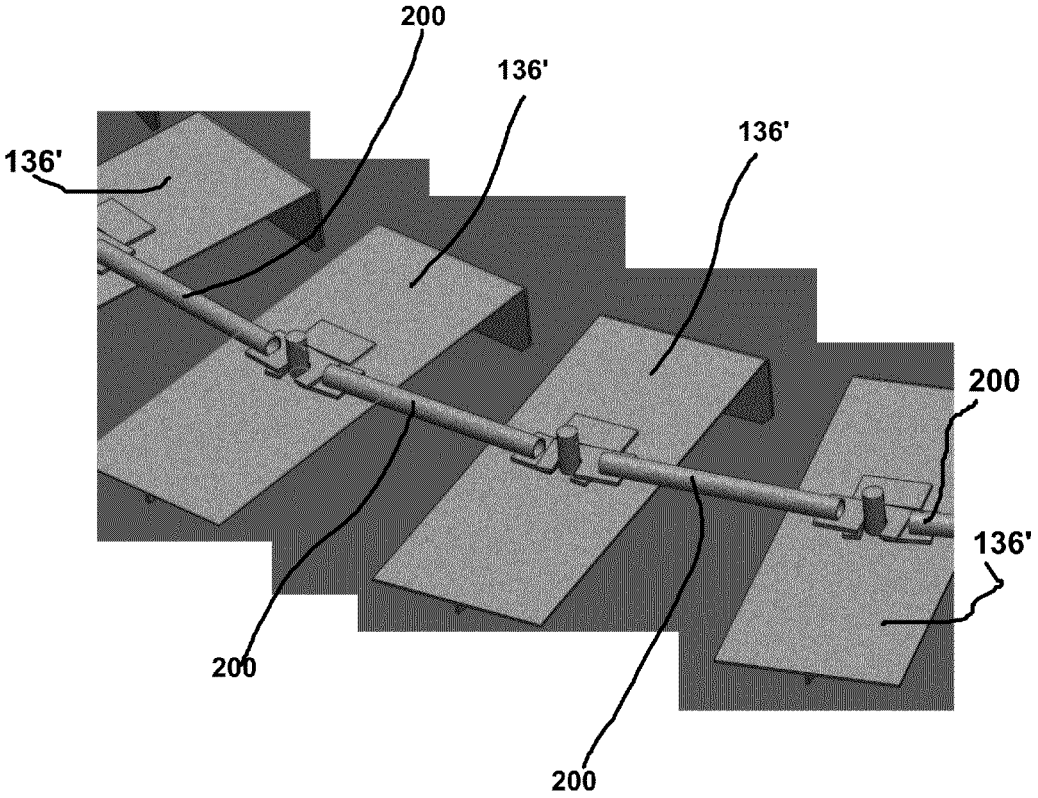

FIG. 39 is an enlarged perspective view of the connections made between rear support plates and horizontally extending links for the corner strut assembly of FIG. 28.

Figure 40:
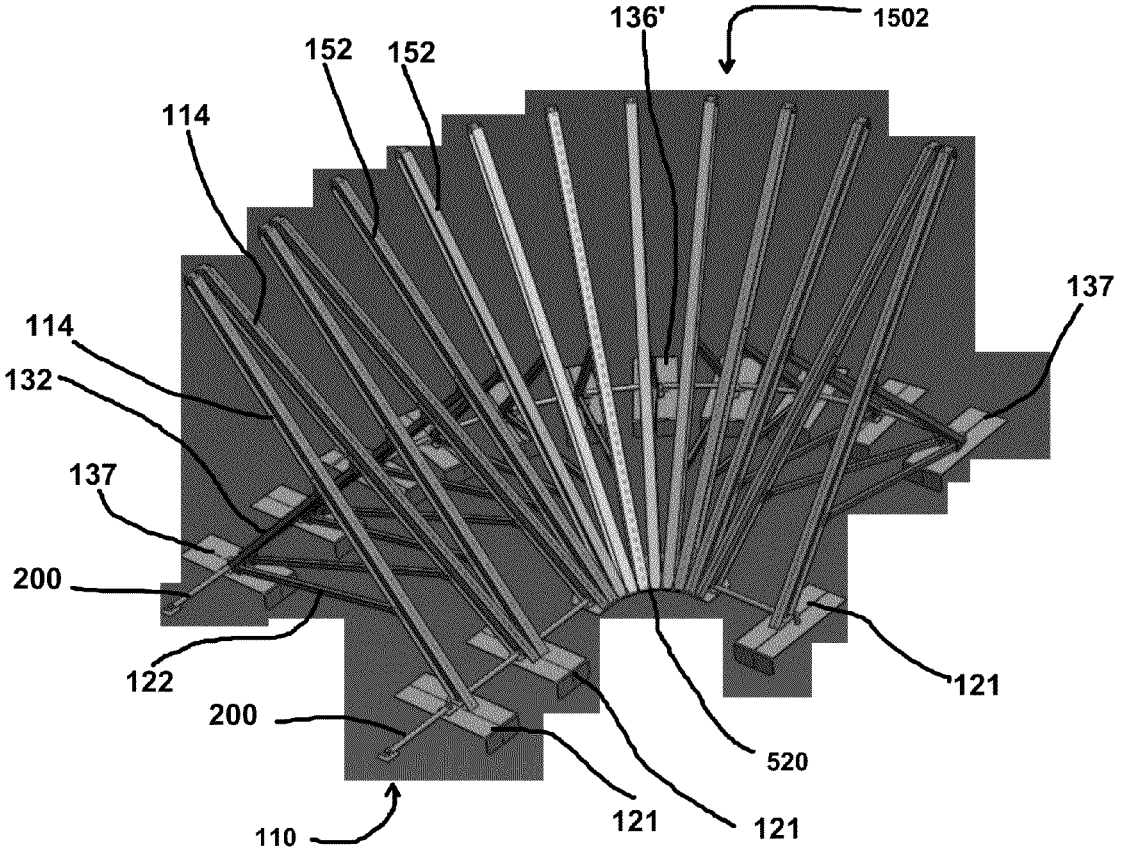

FIG. 40 is a front perspective view of the straight strut assembly of FIG. 19 transitioning to the corner strut assembly of FIG. 28.

Figure 41:
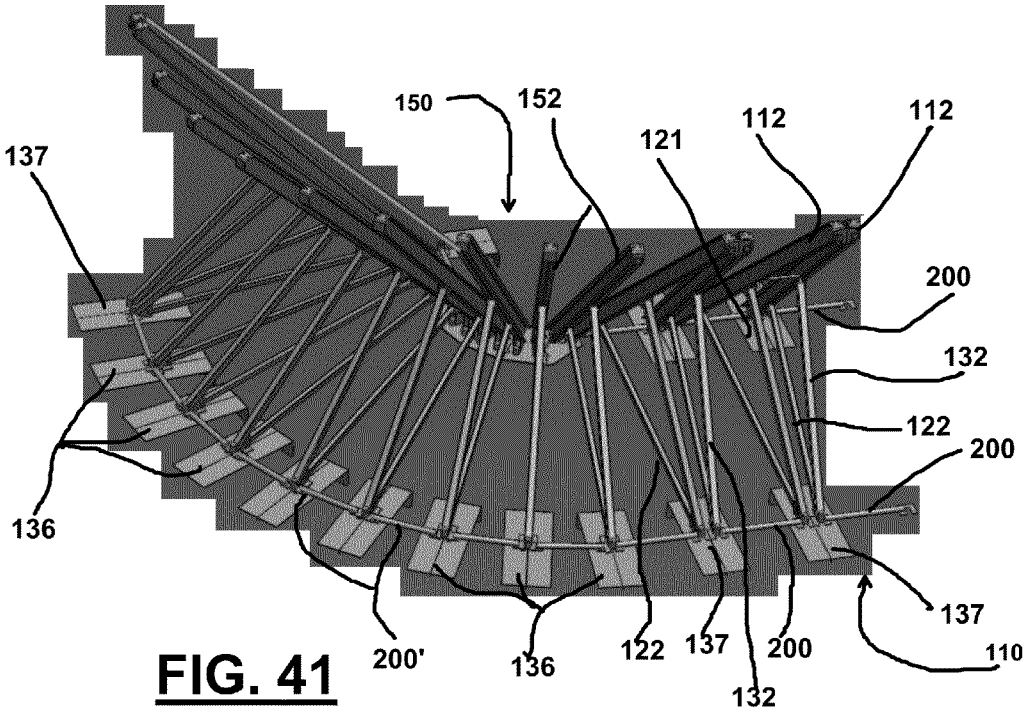

FIG. 41 is a rear perspective view of the straight strut assembly of FIG. 19 transitioning to the corner strut assembly of FIG. 28.

Figure 42:
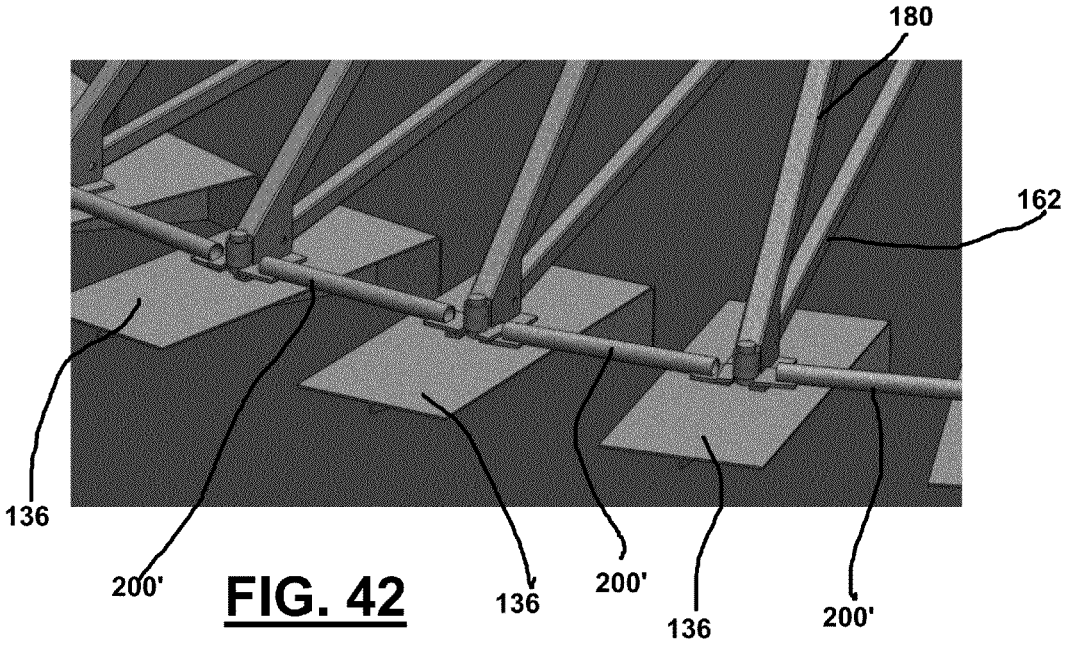

FIG. 42 is an enlarged perspective view of the lower connections between the rear support plates, the upper and lower support members, and horizontally extending links for the corner strut assembly of FIG. 28.

Figure 43:
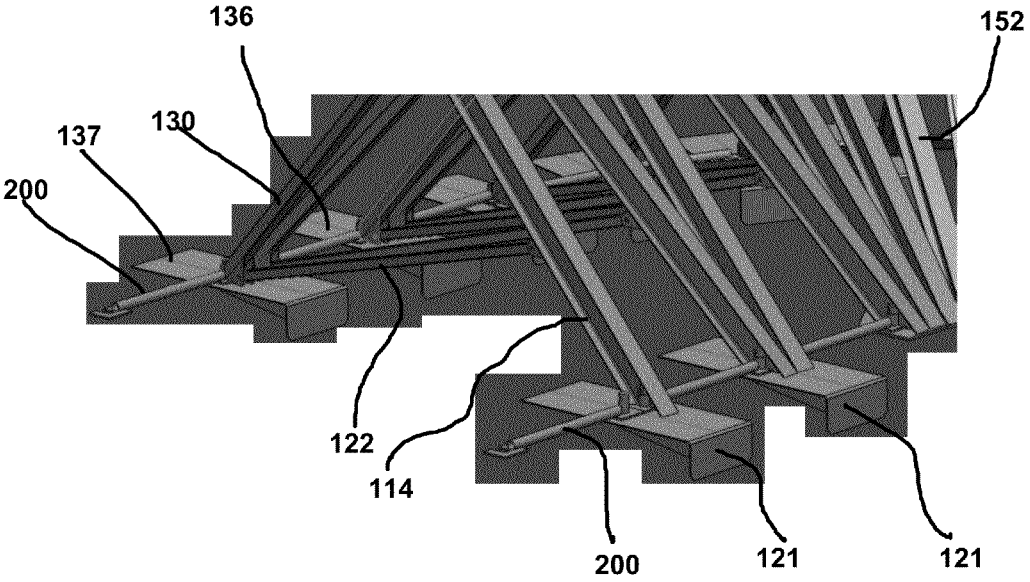

FIG. 43 is an enlarged front perspective view of the straight strut assembly of FIG. 19 transitioning to the corner strut assembly of FIG. 28.

Figure 44:
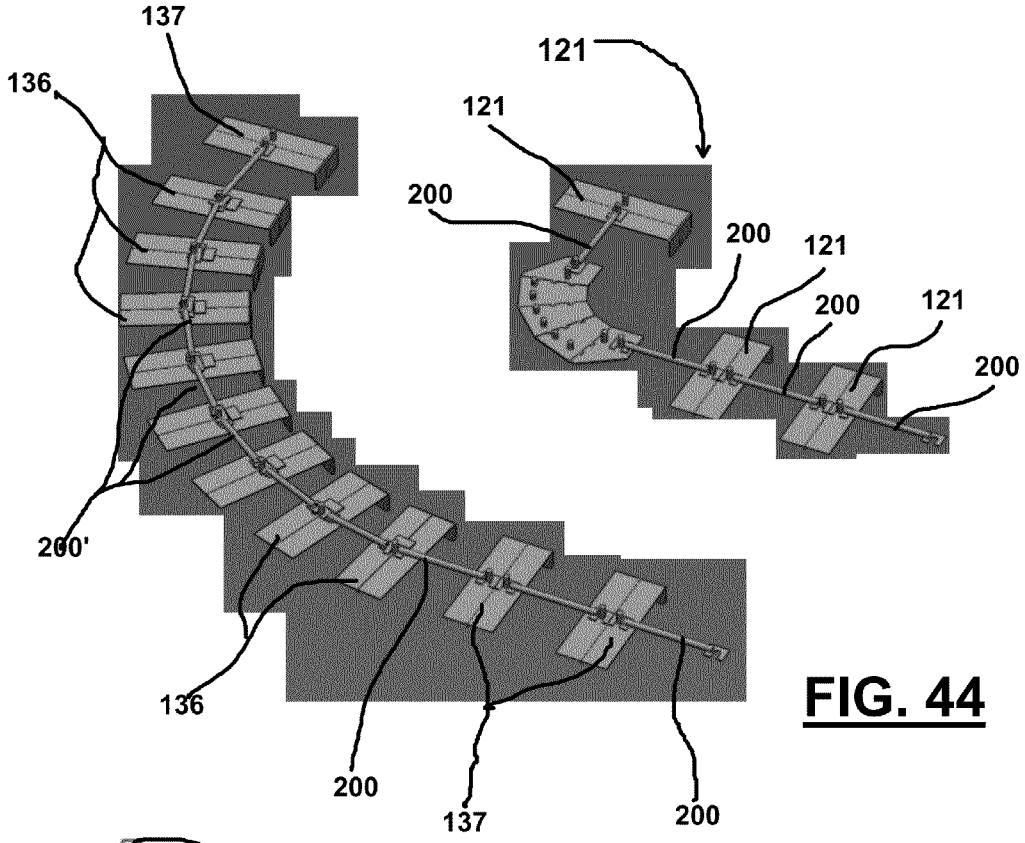

FIG. 44 is an enlarged perspective view of the connections made between rear support plates and horizontally extending links for both the straight strut assembly FIG. 19 and the corner strut assembly of FIG. 28, along with the connections made between front support plates and horizontally extending members 200 for both the straight strut assembly FIG. 19 and the corner strut assembly of FIG. 28.

Figure 45:
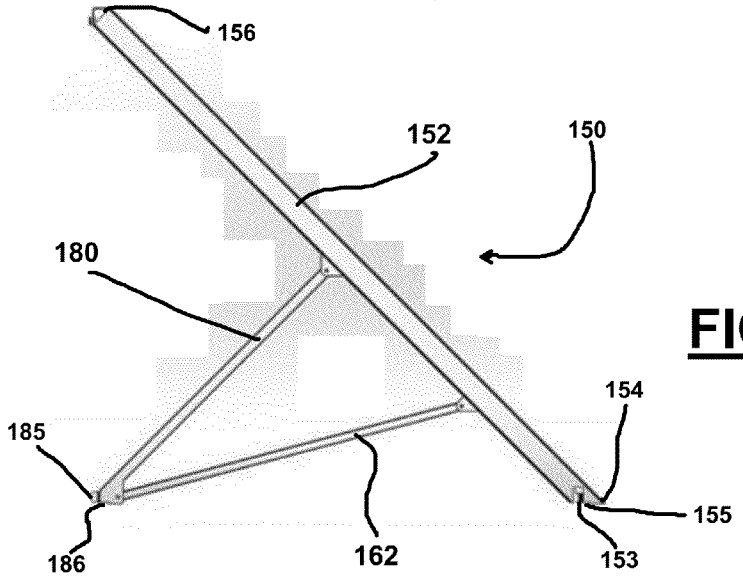

FIG. 45 is a side view of an exemplary strait strut.

Figures 46, 47:
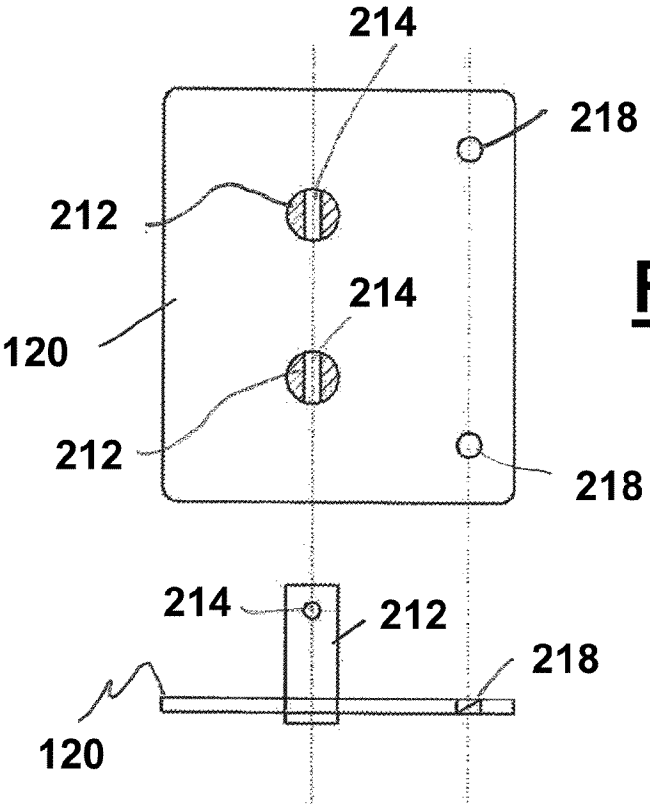

FIG. 46 is a top view of an alternative base plate which can be used with various embodiments.

FIG. 47 is a side view of the base plate of FIG. 46.

Figures 48, 49:
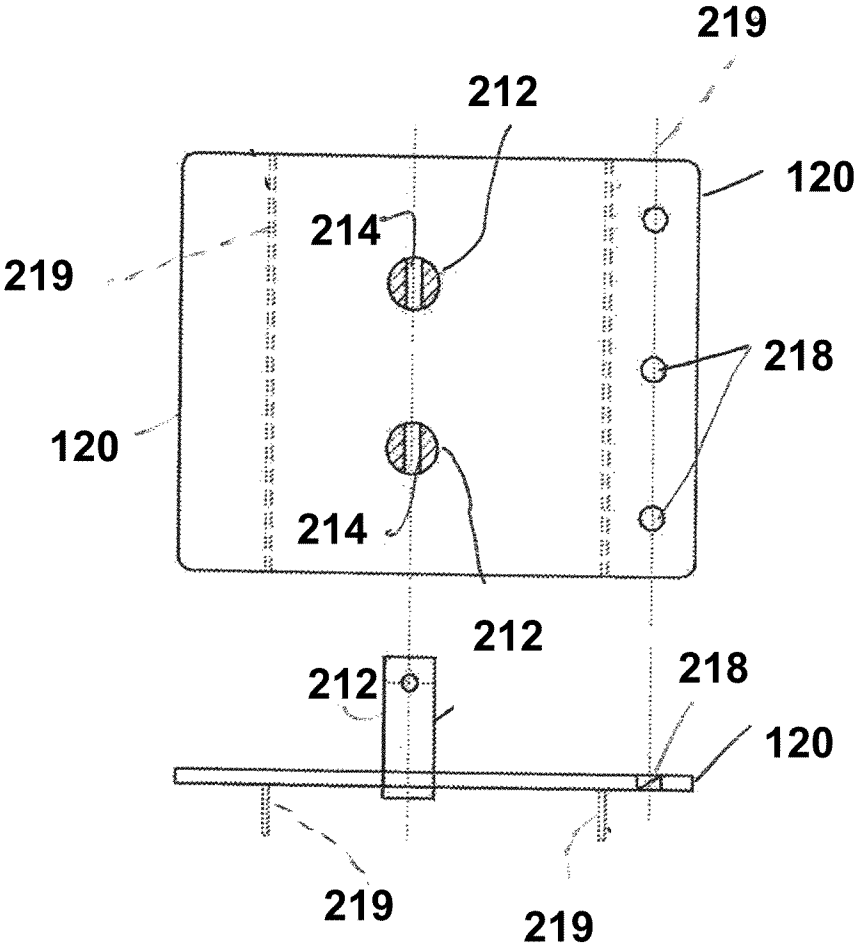
Figure 50:
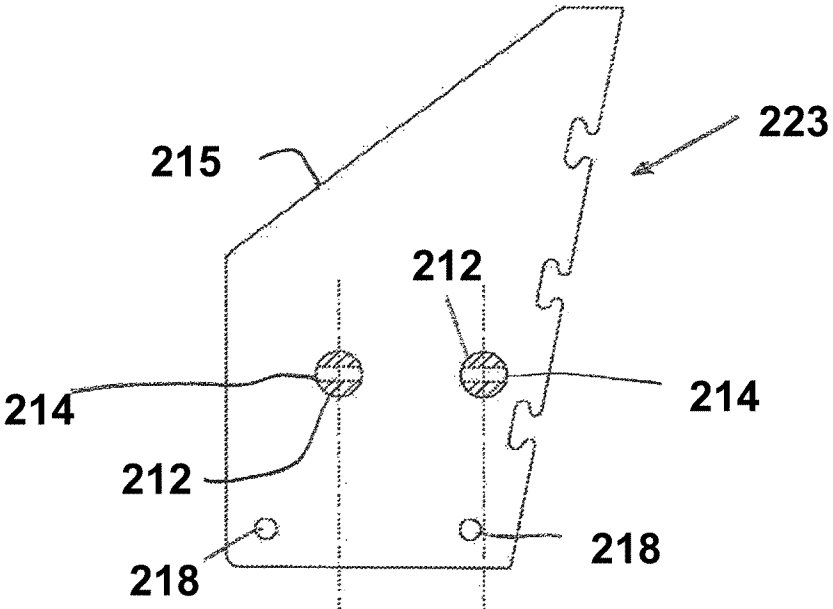
Figure 51:
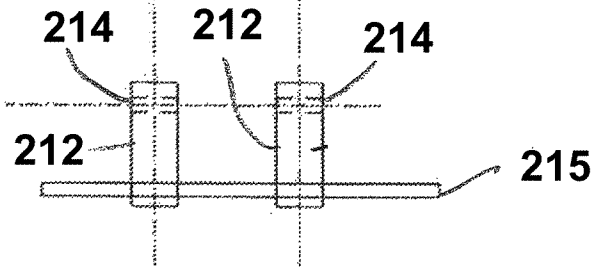
Figure 52:
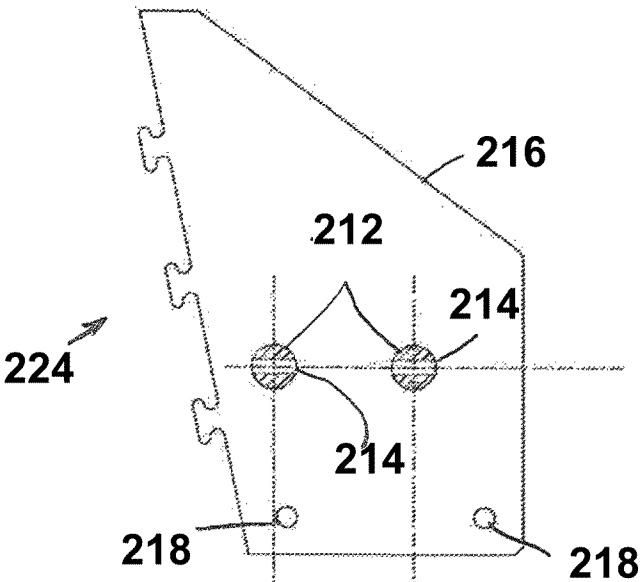
Figure 53:
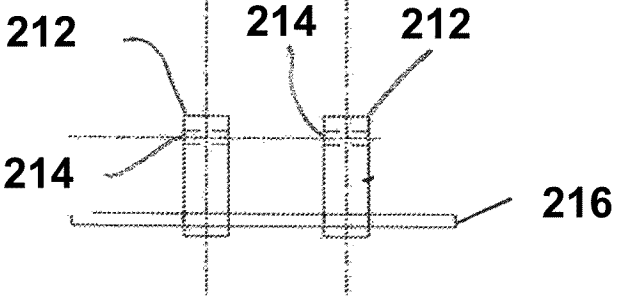
Figure 54:
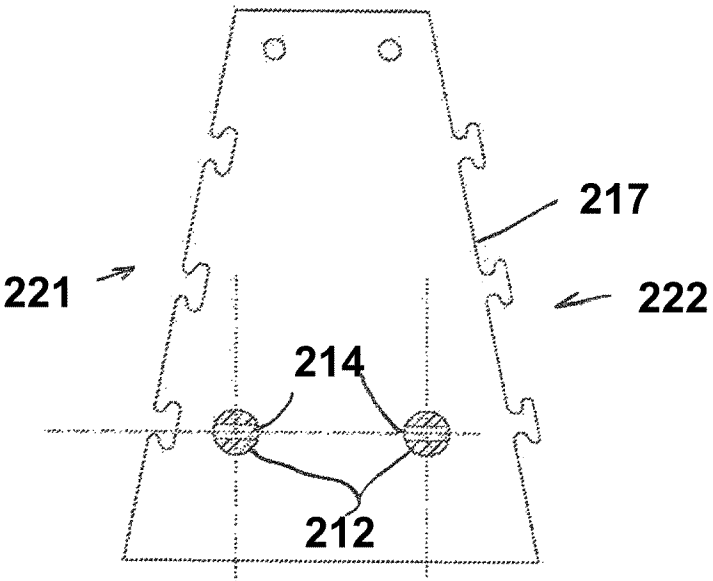
Figure 55:
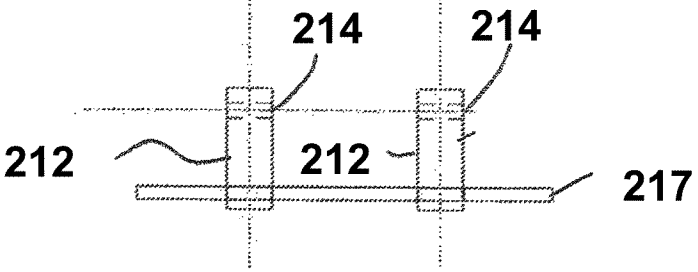

FIG. 48 is a top view of an alternative base plate which can be used with various embodiments.

FIG. 49 is a side view of the base plate of FIG. 48.

FIGS. 50 through 55 are various views of sections of an alternative front base plate which can be used with various embodiments for corner struts.

Figure 56:
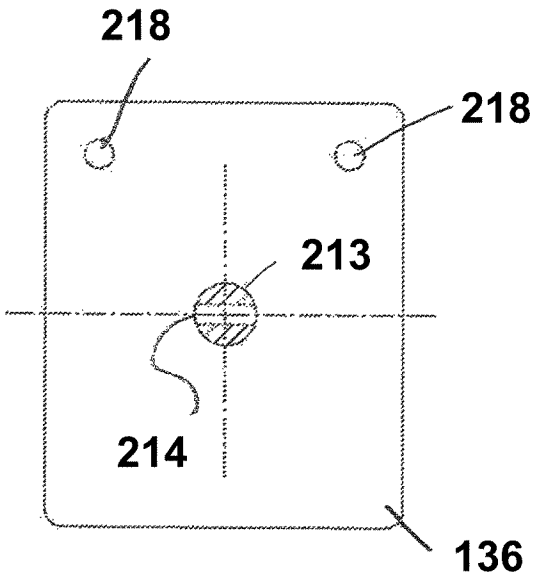

FIG. 56 is a top view of an alternative rear base plate which can be used with various embodiments for corner struts.

Figure 57:
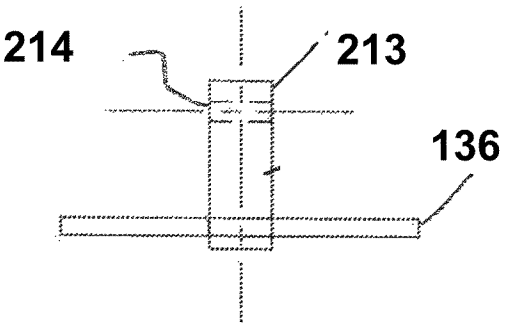

FIG. 57 is a side view of the base plate of FIG. 56.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
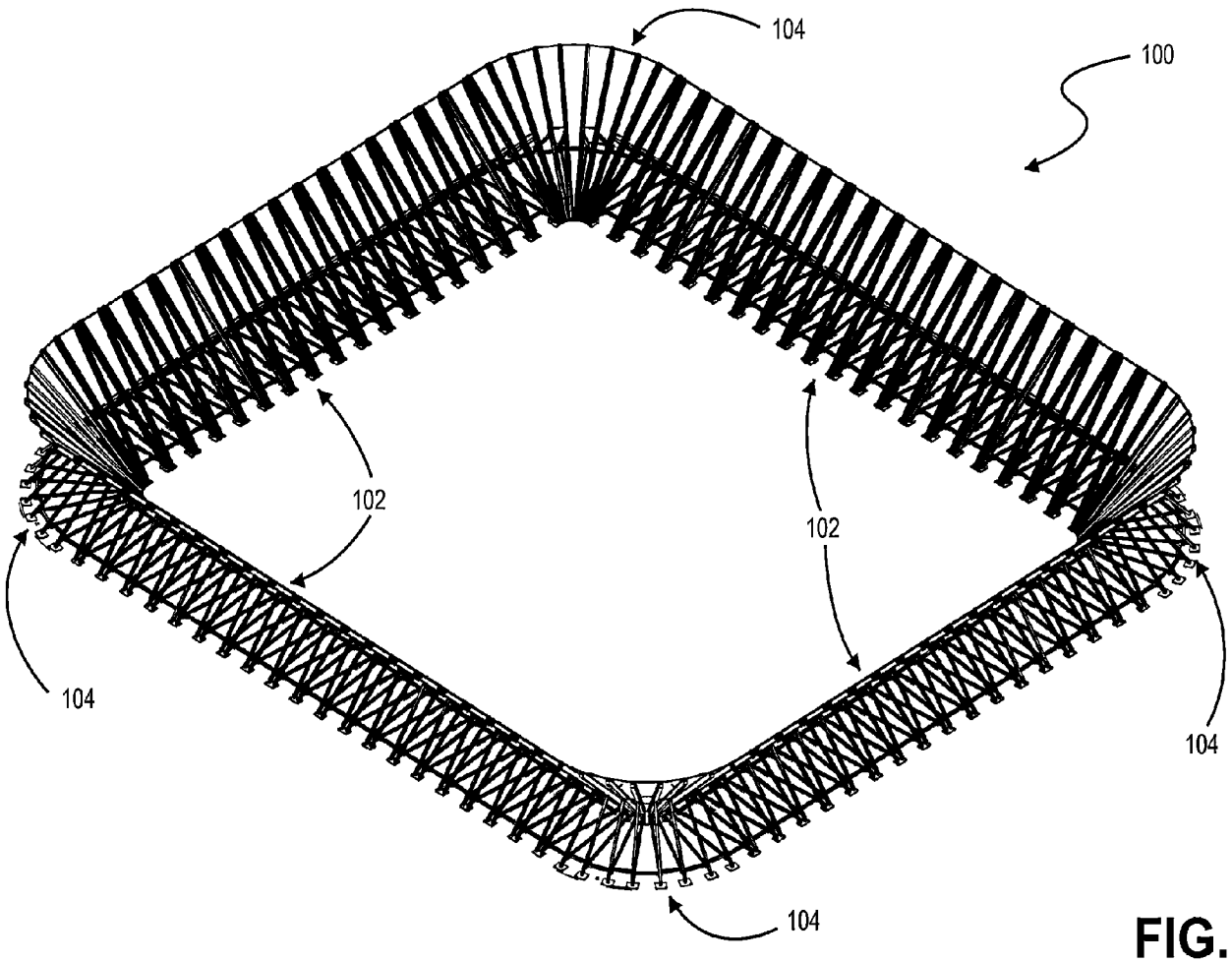
FIG. 1 illustrates an exemplary embodiment of a closed loop containment system in accordance with various aspects of the disclosure.

FIG. 1 is a perspective view of an exemplary closed loop containment system or portable reservoir 100 in accordance with aspects of the disclosure is illustrated and described.

The closed loop containment system 100 may include arrangements 102 of straight strut assemblies 110 and arrangements 104 of corner strut assemblies 150 coupled in a substantially square configuration. It should be appreciated that, in various aspects of the disclosure, the arrangements 102 of straight strut assemblies 110 and the arrangements 104 of corner strut assemblies 150 can be varied to obtain a desired shape as long as the ultimate configuration is closed.

Figure 7:
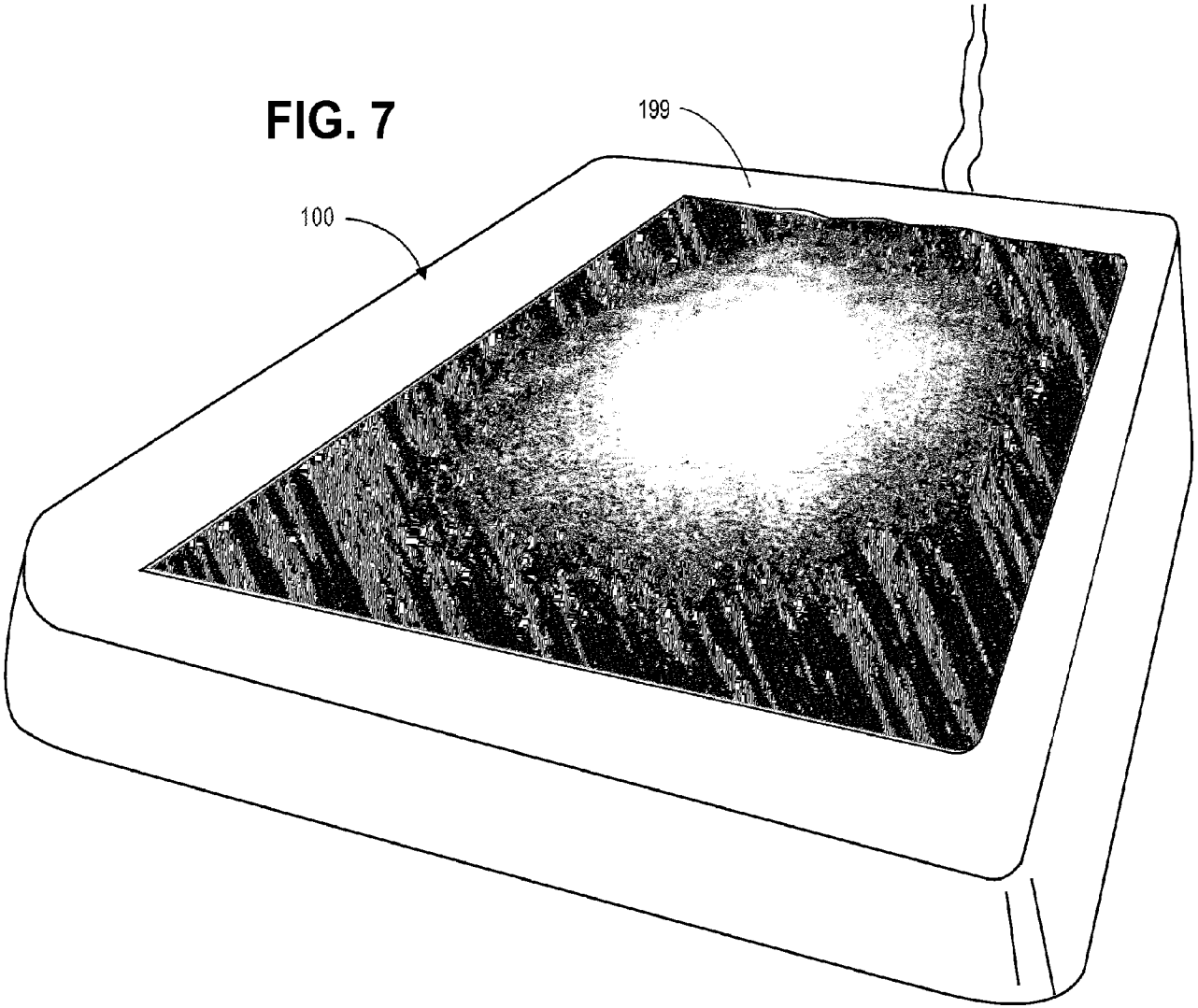
FIG. 7 illustrates an exemplary embodiment of an above ground containment system in accordance with various aspects of the disclosure.
Figure 16:
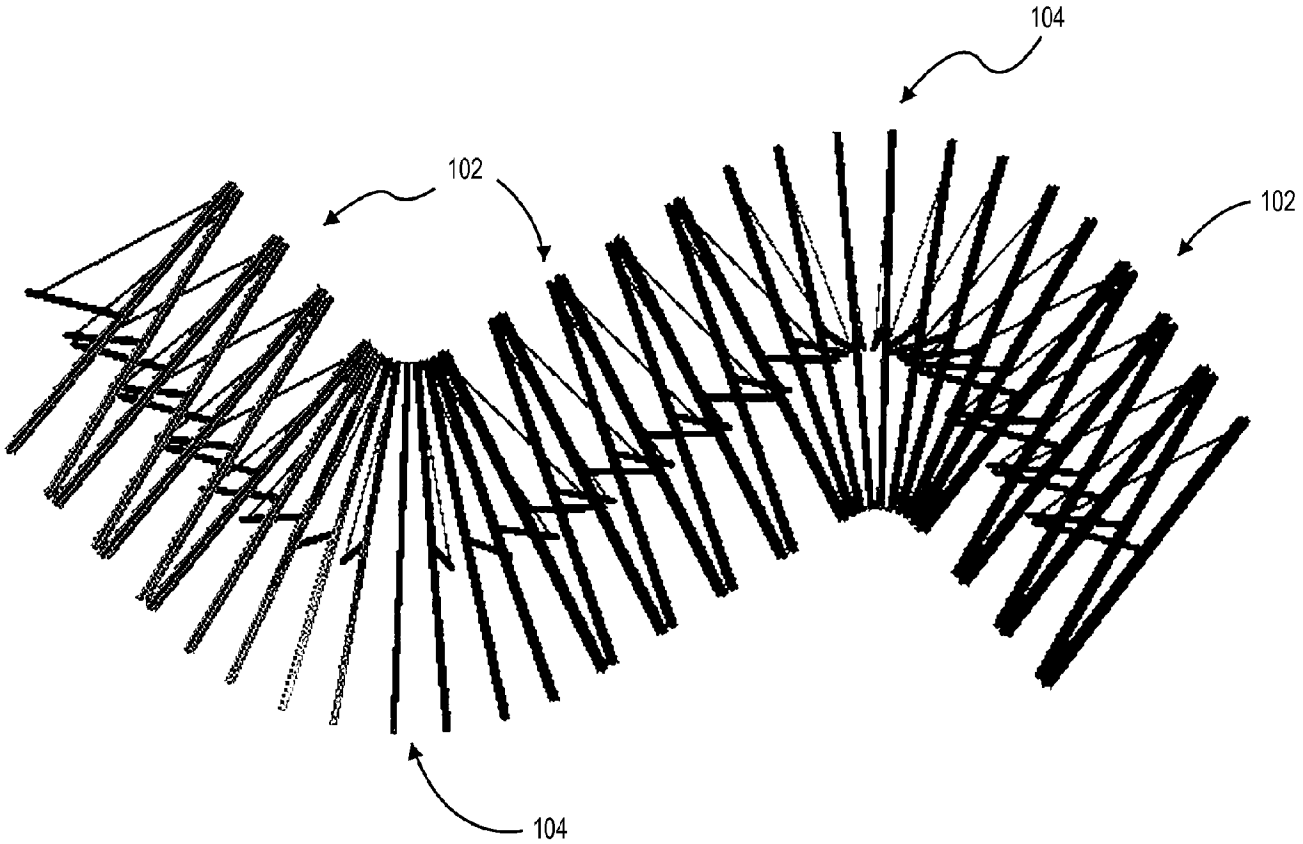
FIG. 16 shows a varied shape system using one or more corner and straight strut assemblies from one or more embodiments.

In one embodiment the corner arrangements 104 can be built in 22.5 degree increments thus allowing for construction of any desired size, shape, and configuration including a combination of straight sides and/or turns in 22.5 degree increments. As shown in FIG. 16, the corner arrangements 104 are interchangeable and designed to have 'inside' and 'outside' geometry, thereby permitting construction of different shaped containment systems including square, rectangular, trapezoidal, and "L" and "U" shapes. Thus, in different embodiments systems 100 in accordance with the present disclosure can be used for both closed loop containment, as well as dam and diversion applications. In either case, the system 100 may be lined with a water-impermeable liner 199, as is known by persons of ordinary skill in the art (FIG. 7). For example, the liner 199 may comprise any geogrid, geotextile, and liners and/or combination thereof. Some materials may include, for example, polypropylene, polyethylene, IDPE, and spray on rubber/plastics.

FIGS. 2-3, 17-25 show exemplary embodiments of a straight strut assembly 110. The straight strut assembly 110 may include two strut members 112. According to various aspects, the strut members 112 may be substantially identical beams (i.e., within the parameters of conventional manufacturing tolerances), such as, for example, I-beams. It should be appreciated that the strut members 112, according to various aspects, may be tubes, channels, angles, pipes, flanged beam, wide flanged beams or a like structural member. It should further be appreciated that the strut member 112 may be metal (e.g., aluminum), wood, and/or a composite.

Figure 8:
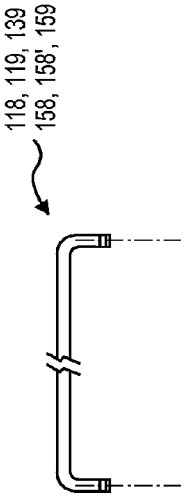

The strut members 112 each have a first end 114 coupled with a front base plate 120 or 121 and extend away from the front base plate 120 or 121 in a V-shaped configuration. The strut members 112 each have a second end 116 spaced a distance from one another and coupled with one another via a coupling member 118. According to various aspects, the coupling member 118 may be a drop pin, such as that shown in FIG. 8.

The straight strut assembly 110 may include a pair of base members 122 and a pair of support members 130, 130'. Each base member 122 has a first end 124 pivotally coupled with one of the strut members 112 near the first end 114 thereof. Each support member 130 has a first end 132 pivotally coupled with one of the strut members 112 at a joint 115 intermediate the first and second ends 114, 116. A second 134 of one of the support members 130 may be coupled with a first rear base plate 136, and a second end 134' of the other support member 130' may be coupled with a second rear base plate 136'. In FIGS. 17-25 rear base plate 137 is shown of different configuration.

Figure 2:
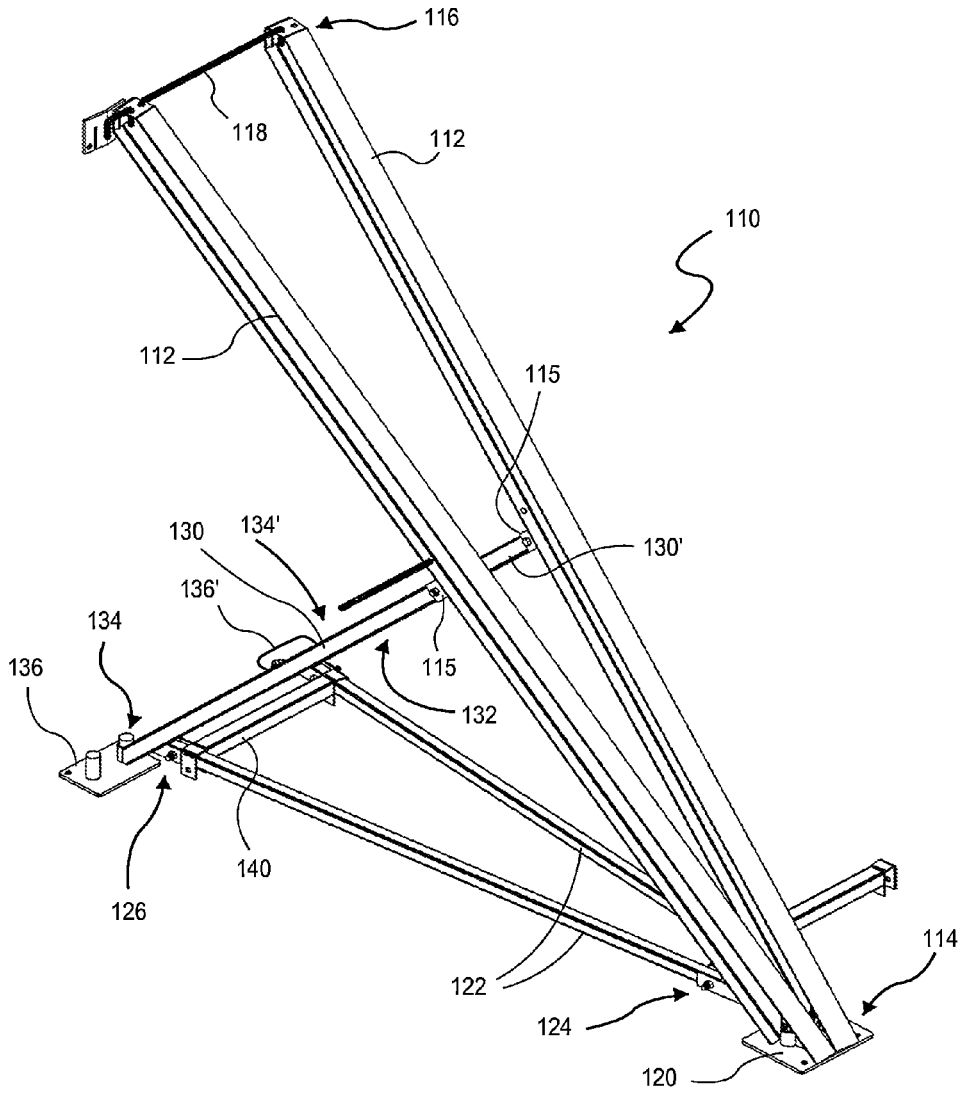
FIG. 2 illustrates an exemplary embodiment of a straight strut assembly in accordance with various aspects of the disclosure.

As shown in FIG. 2, the base members 122 extend from the front base plate 120 in a diverging configuration. Thus, second ends 126 of the base members 122 are spaced from one another substantially the same distance as the second ends 116 of the strut members 112. The second end 126 of the base members 122 are coupled to the respective support members 134, 134'.

Figure 9:
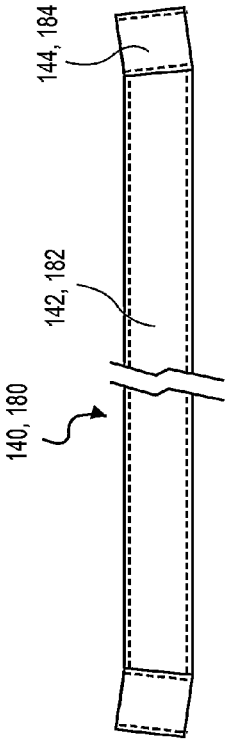

In various embodiments the base members 122 can also be coupled to one another proximate their second ends 126 by a rear coupling 140. As shown in FIG. 9, the rear coupling 140 may comprise a bar 142 having angled receiving members 144, for example, channels, at each end of the bar 142. The angled receiving members 144 are structured and arranged to receive the second ends 126 of the base members 122 at substantially the same angle at which the base members 122 diverge from one another. As shown in FIG. 2, the angled receiving members 144 may be placed above the base members 122 relative to a ground surface. The angle receiving members 144 may include an optional opening on each side of the base member 122 to receive a coupling member (not shown), such as for example, a pin, a bolt, or the like, to prevent the rear coupling from inadvertently dislodging from the base members 122 during assembly.

In various embodiments rear support plates 121 can be coupled directly to each other by connecting links 200 (such as the link 200 shown in FIG. 33).

Figure 3:
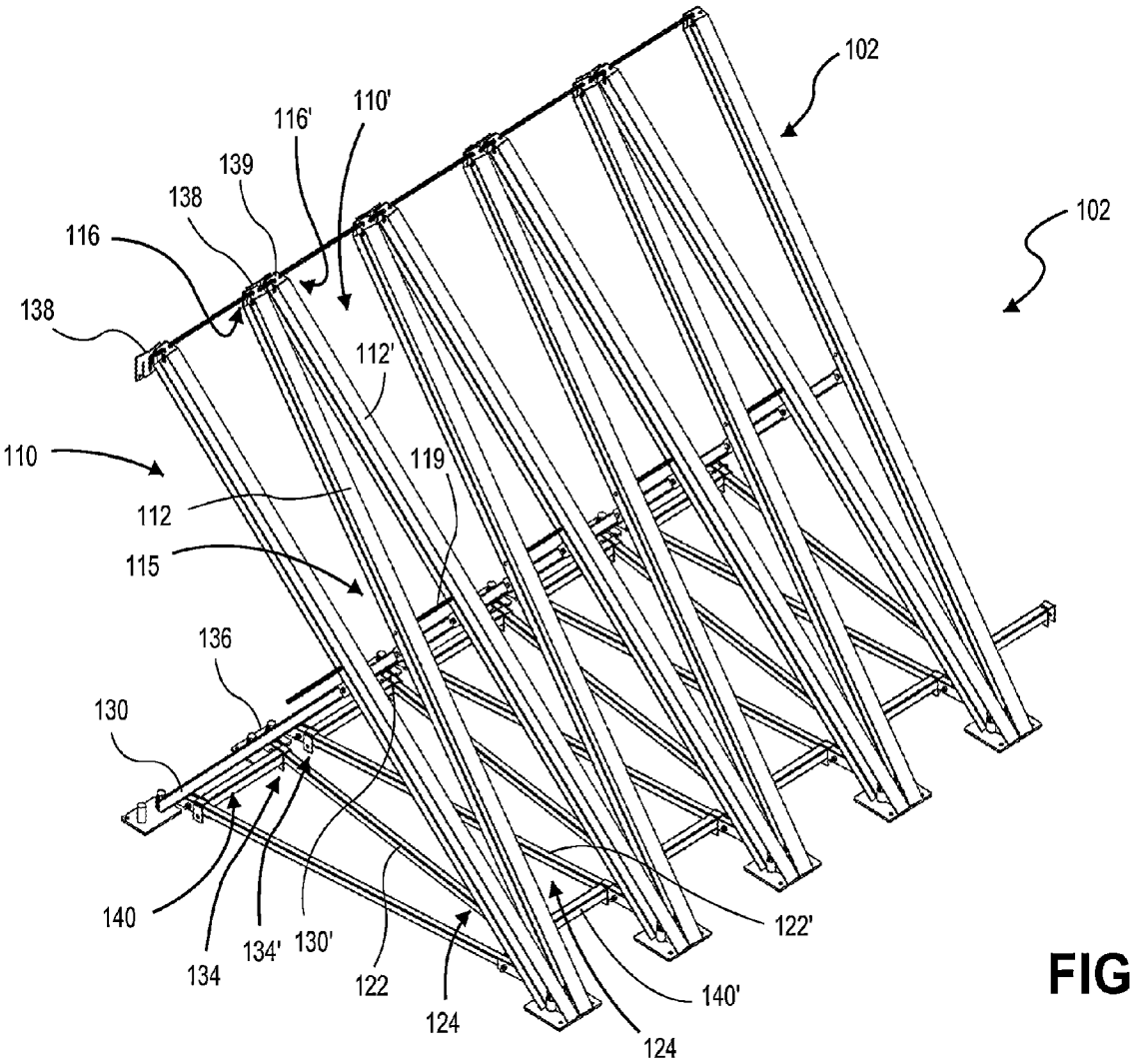
FIG. 3 illustrates an exemplary arrangement of straight strut assemblies.
Figure 10A:
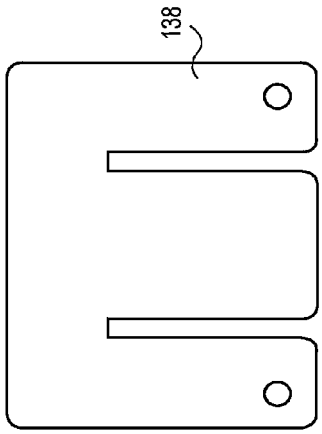
FIGS. 8-13 show various components of the exemplary system.
Figure 10B:
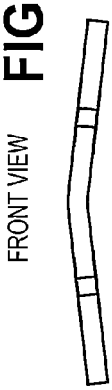
Figure 12:
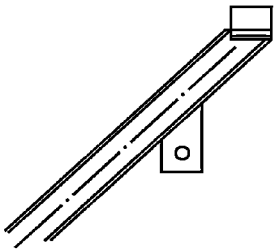
Figure 13:
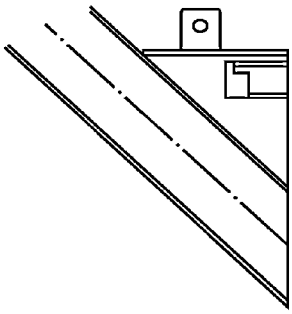

FIG. 3 is an exemplary arrangement 102 of straight strut assemblies 110 is illustrated and described. The arrangement 102 includes a plurality of the V-shaped strut assemblies 110 coupled together to form an alternating "V and "inverted V" pattern. The second ends 116, 116' of a pair of adjacent straight strut assemblies 110, 110' may be coupled together via a rear plate 138 (FIGS. 10A and 10B). The strut members 112, 112' of adjacent assemblies 110, 110' may be coupled to one another at an intermediate point 115 along their length by an intermediate coupling member 119 similar in structure to coupling member 118, but proportionately sized to span the distance between the two intermediate points 115 rather that the distance between the two second ends 116. It should be appreciated that other coupling members known to a person of ordinary skill in the art are contemplated by the disclosure. Optionally, an end coupling member 139 may couple the second ends 116, 116' of a pair of adjacent straight strut assemblies 110, 110'. The end coupling member 139 may be similar in structure to coupling members 118, 119, but proportionately sized to span the distance between the adjacent second ends 116, 116'. It should be appreciated that other coupling members known to a person of ordinary skill in the art are contemplated by the disclosure.

As shown in FIG. 3, the second end 134 of the support member 130 (obstructed in FIG. 3) of a first straight strut assembly 110 may be coupled to the same rear base plate 136 as a second end 134' of the support member 130' of a second straight strut assembly 110'. The rear base plates 136 are spaced from one another substantially the same distance as the front base plates 120. Thus base members 122, 122' of adjacent strut assemblies 110, 110' may be coupled to one another proximate their first ends 124 by a front coupling 140'. Similar to rear coupling 140, front coupling 140' may comprise a bar 142' having angled receiving members 144', for example, channels at each end of the bar 142'. The angled receiving members 144' are structured and arranged to receive the first ends 124 of the base members 122, 122' at substantially the same angle at which the base members 122, 122' diverge from one another. As shown in FIG. 3, the angled receiving members 144' may be placed above the base members 122, 122' relative to a ground surface. The angle receiving members 144' may include an optional opening on each side of the base member 122, 122' to receive a coupling member (not shown), such as for example, a pin 213, a bolt, or the like to prevent the rear coupling from inadvertently dislodging from the base members 122, 122' during assembly.

Figure 4:
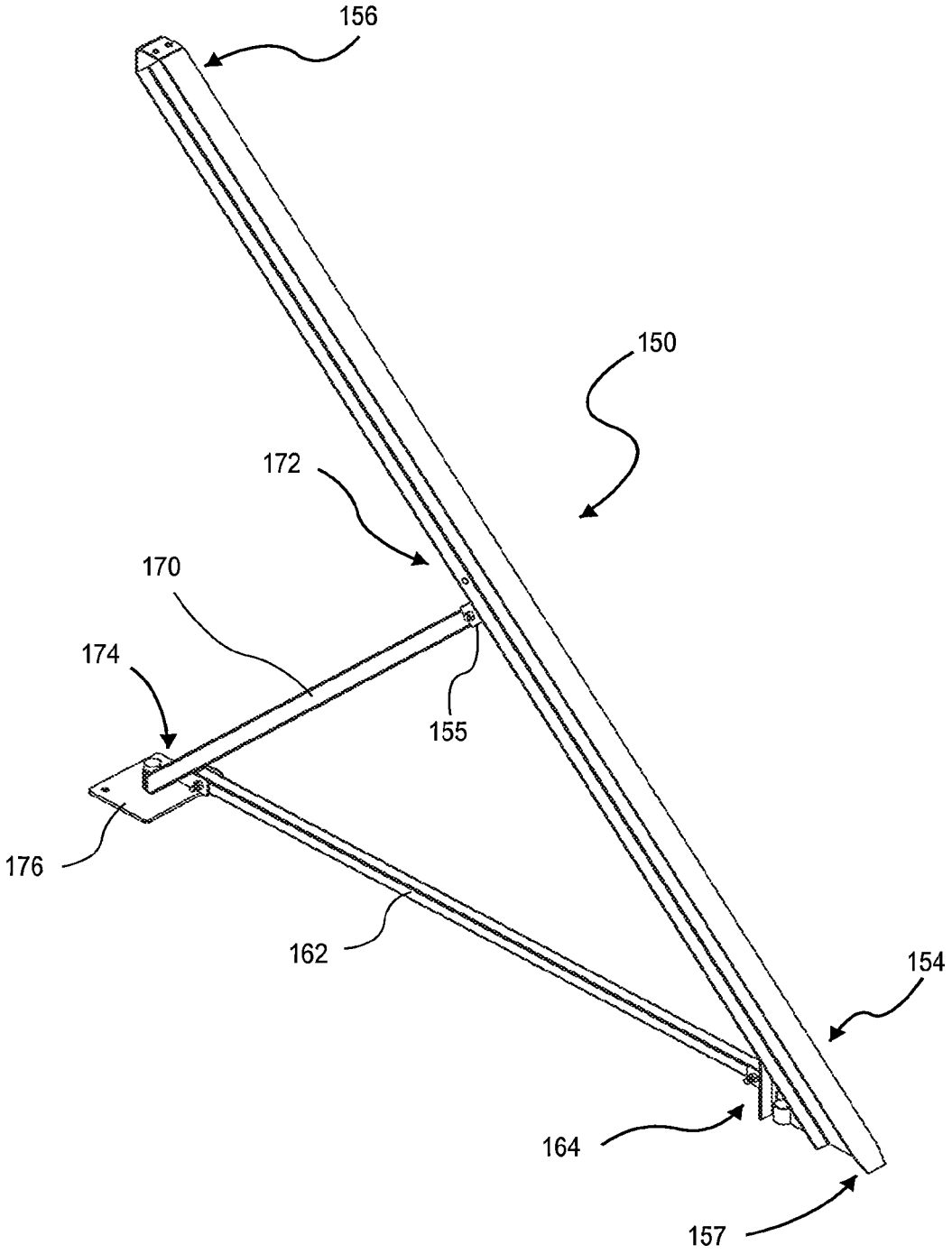
FIG. 4 illustrates an exemplary embodiment of a corner strut assembly in accordance with various aspects of the disclosure.

FIG. 4 is an exemplary corner strut assembly 150 is illustrated and described. The corner strut assembly 150 may include a strut member 152. According to various aspects, the strut member 152 may be a beam similar to the strut members 112 of the straight strut assembly 110. The strut member 152 may have a first end 154 configured to be coupled with a front base plate and a free second end 156 or 156'. The first end 154 may include a tapered region 157 to accommodate the close abutment of adjacent corner strut assemblies 150 required to achieve, for example, a 22.5 degree turn at a desired turning radius. The corner strut assembly 150 may include a base member 162 and a support member 170. The base member 162 has a first end 164 pivotally coupled with the strut member 152 near the first end 154 thereof. The support member 170 has a first end 172 pivotally coupled with the strut member 152 at a joint 155 intermediate the first and second ends 154, 156, 156'. A second end 174 of the support member 170 may be coupled with a rear base plate 176, and a second end 166 of the base member 162 may be coupled with the support member 170 proximate the second end 174 thereof.

Figure 5:
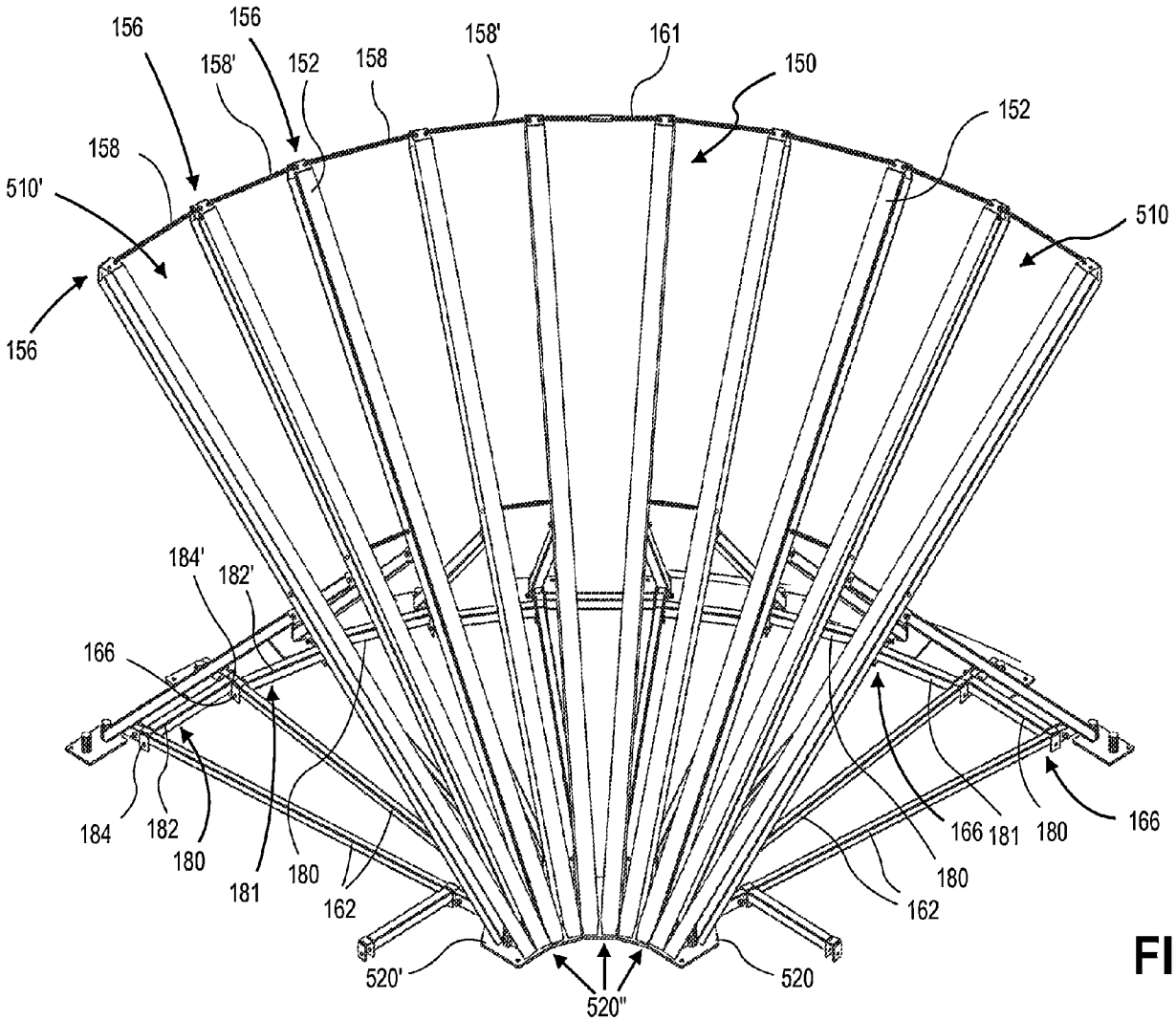
FIG. 5 illustrates an exemplary arrangement of corner strut assemblies.
Figure 6:
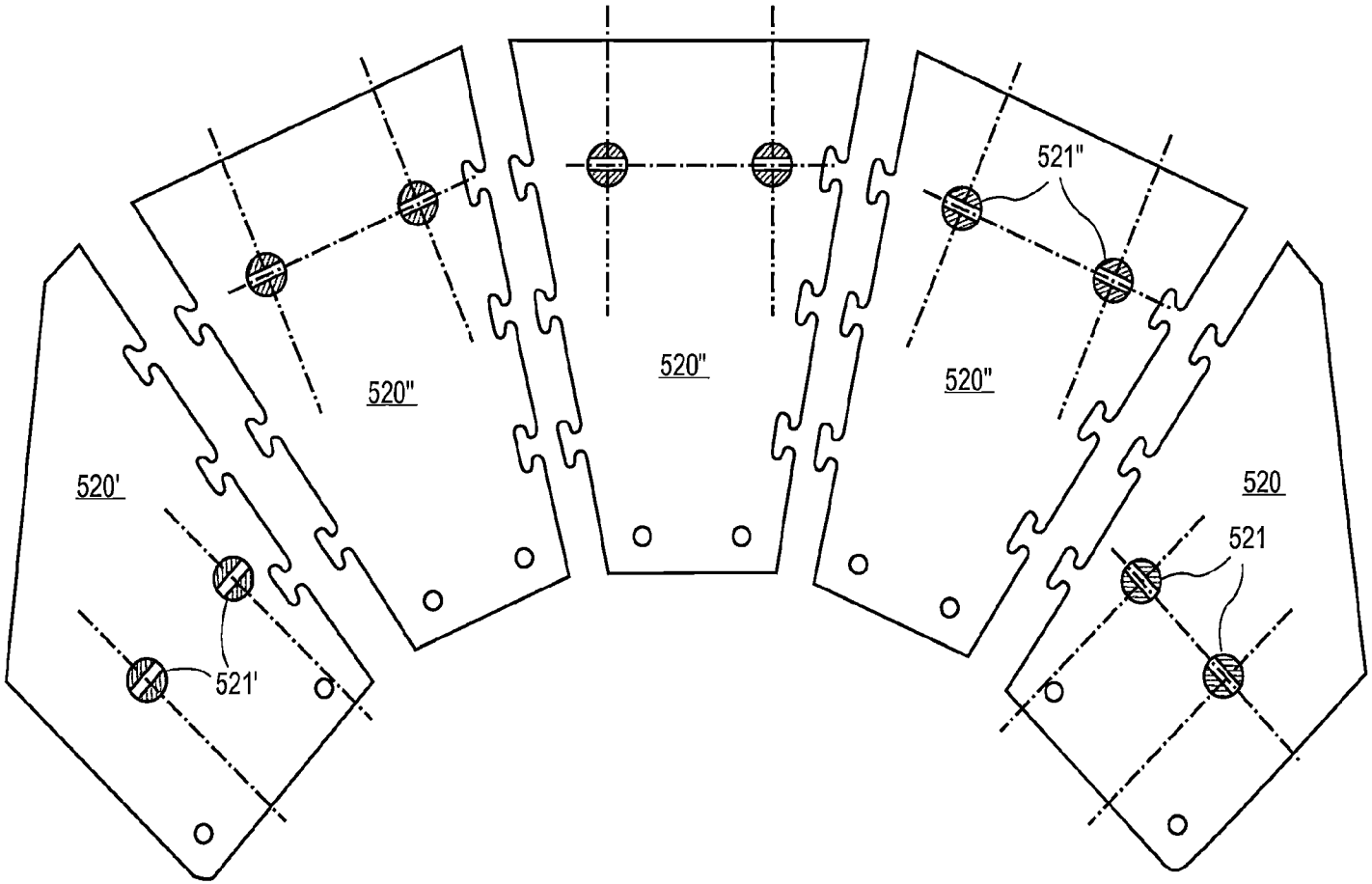
FIG. 6 illustrates an exploded view of a corner base plate assembly in accordance with various aspects of the disclosure.
Figure 11:
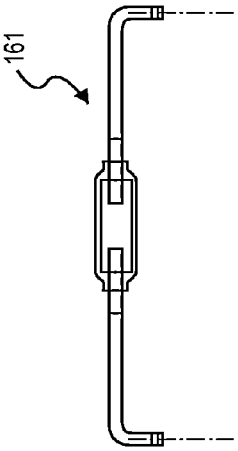
Figure 14A:
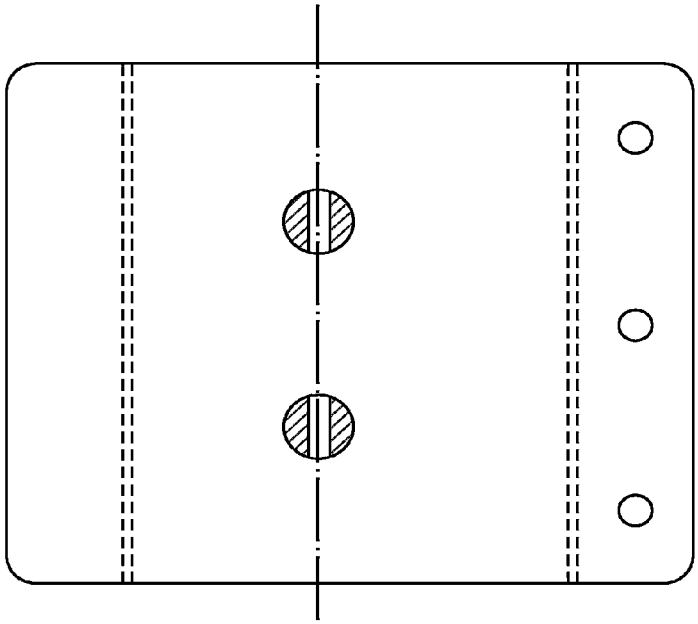
FIGS. 14A and 14B are respective top and side views of a base plate which can be used with various embodiments.
Figure 14B:
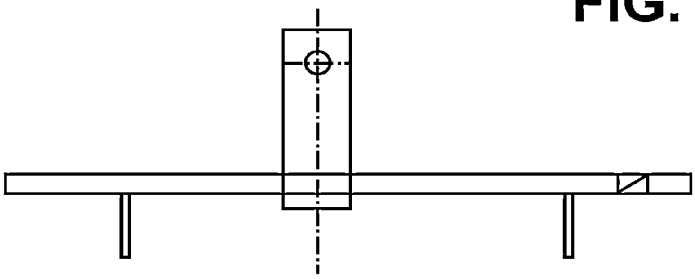
Figure 15:
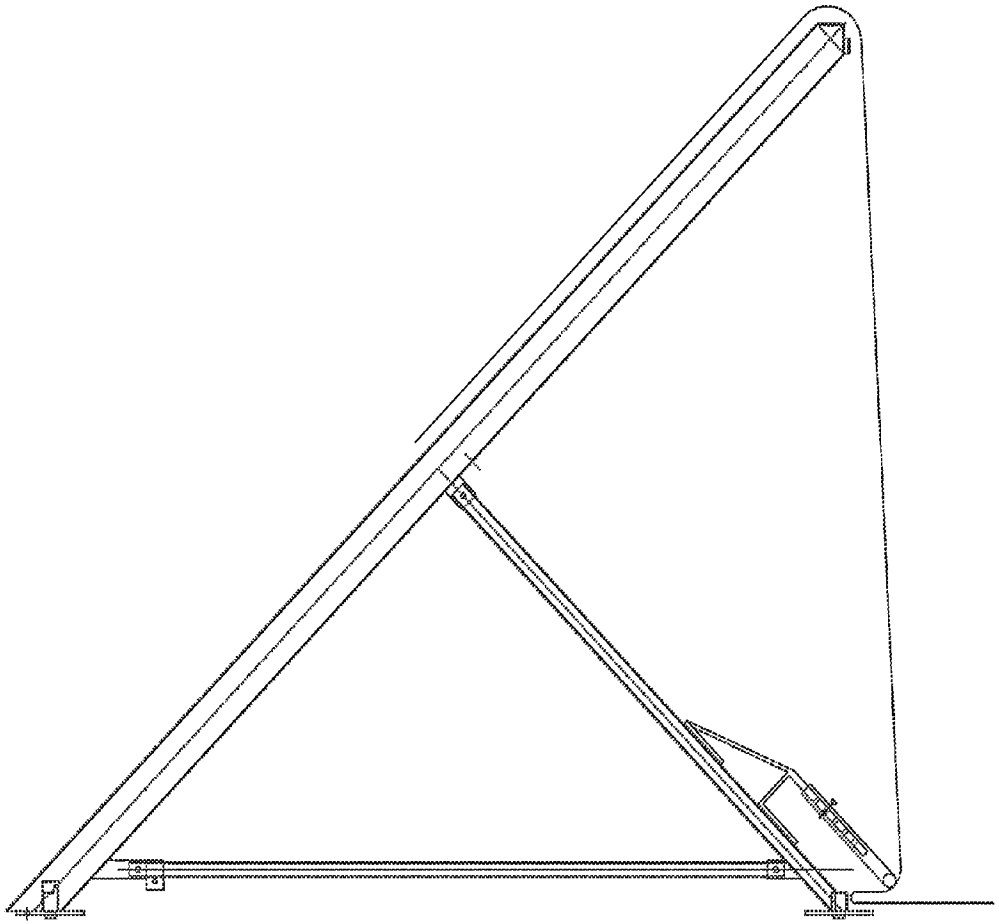
FIG. 15 shows a side view of a hold down system for a liner for various embodiments.

Referring now to FIGS. 5, 6, and 11, an exemplary arrangement 104 of corner strut assemblies 150 is illustrated and described. The arrangement 104 includes a plurality of curved strut assemblies 150 coupled together between a pair of straight strut assemblies 510, 510'. For example, as shown in FIG. 5, the two rightmost strut members 112 comprise a V-shaped straight strut assembly 510 similar to the straight strut assembly 110 described above in connection with FIG. 2. Similarly, the two leftmost strut members 112 comprise a V-shaped straight strut assembly 510' similar to the straight strut assembly 110 described above in connection with FIG. 2. However, the straight strut assemblies 510, 510' may be coupled with a right front base plate 520 and a left front base plate 520', respectively.

Each of the corner strut assemblies 150 is connected to a center front base plate 520". In the exemplary embodiment of FIGS. 5 and 6, the arrangement 104 includes six corner strut assemblies 150. Although FIGS. 5 and 6 illustrate three center front base plates 520" having two pins 521" for coupling two corner strut assemblies 150, it should be appreciated that the center front base plates 520" may include one pin or more than two pins, depending on the desired corner configuration.

As shown in FIG. 5, adjacent ones of the free second ends 156 of the corner strut assemblies 150 may be connected to one another via coupling members 158, 158'. The length of the coupling members 158, 158' may vary depending on the desired corner configuration. In the illustrated exemplary embodiment, every other adjacent pair of second ends 156 may include a coupling member 158 sized substantially similar to coupling member 118. The intervening coupling members 158' may be sized similar to one another but different than, for example, shorter than, the coupling members 158. Two free second ends 156' of the arrangement 104, for example, the centermost free ends in some aspects, may be coupled with an adjustable connecting member 161. For example, the adjustable connecting member 161 may be a turnbuckle-type connecting member as shown in FIG. 11. The adjustable connecting member 161 may facilitate proper curvature and configuration of the system 100.

FIGS. 17-45 show various detailed or close up fragmentary views of a preferred alternative embodiment of the method and apparatus of the present invention.

In some aspects of the arrangement 104, the base members 162 of adjacent straight and corner strut assemblies 110, 150 that are coupled to the same front base plates 520, 520', 520"

may be coupled to one another proximate their second ends 166 by a rear coupling 180. The rear coupling 180 may comprise a bar 182 having angled receiving members 184, for example, channels, at each end of the bar 182. The angled receiving members 184 are structured and arranged to receive the second ends 166 of the base members 162 at substantially the same angle at which the base members 162 diverge from one other. As shown in FIG. 2, the angled receiving members 184 may be placed above the base members 162 relative to a ground surface and radially inward relative to the base members 162.

In various alternative embodiments, rear couplings 180 can be omitted, and rear support plates 136' can be coupled directly to each other by connecting links 200' (such as the link 200 shown in FIG. 38).

In some aspects of the arrangement 104, the base members 162 of adjacent straight and/or corner strut assemblies 110, 150 that are not coupled to the same front base plates 520, 520', 520" may be coupled to one another proximate their second ends 166 by a rear coupling 181. The rear coupling 181 may comprise a bar 182' having angled receiving members 184', for example, channels, at each end of the bar 182'. The angled receiving members 184' are structured and arranged to receive the second ends 166 of the base members 162 at substantially the same angle at which the base members 162 diverge from one another. As shown in FIG. 2, the angled receiving members 184' may be placed above the base members 162 relative to a ground surface and radially inward relative to the base members 162. The angle receiving members 184, 184' may include an optional opening on each side of the base member 162' to receive a coupling member (not shown), such for example, a pin, a bolt, or the like, to prevent the rear coupling from inadvertently dislodging from the base members 162 during assembly.

In some aspects, adjacent strut members 152 that are not coupled to the same center front base plates 520" may be coupled to one another at an intermediate point 165 along their length by an intermediate coupling member 159 similar in structure to coupling member 158', but proportionately sized to span the distance between the two intermediate points 155 rather than the distance between the two second ends 156. It should be appreciated that other coupling members known to a person of ordinary skill in the art are contemplated by disclosure.

FIGS. 17-45 illustrate in more detail the system 100 of the present invention. FIGS. 36, 39, and 44 illustrate the capacity to place or layout a plurality of the various base members in advance and without having to erect the strut members 112, 112' or base members 122, 122' or support members 130, 130'.

FIG. 44 is an enlarged perspective view of the connections made between rear base/support plates 137 and horizontally extending links 200, 200' for both a straight strut assembly 110 and a corner strut assembly 150, along with the connections made between front base/support plates 121 and horizontally extending members 200 for both a straight strut assembly 110 and a corner strut assembly 150. In some embodiments at least 50 percent of the base members (e.g., front and rear base plates with connectors between front base plates and connectors between rear base plates) can be first laid out before erecting the strut members (e.g., 112,152) on the base member. In other embodiments at least 55, 60, 65, 70, 75, 80, 85, 90, 95, and/or 100 percent of the base member can be first laid out. In different embodiments a range of base members between any two of the above referenced percentages can be first laid out. Such first laying out of the base members with horizontal connecting links enables simplifying of the erection of arrangements 102, 104 of straight strut assemblies 110, 110' and corner strut assemblies 150.

In FIGS. 36, 39 and 44, front base plates 121, rear base plates 136, 137 and corner front plates 215, 216, 217 are first placed to define a geometric layout or footprint of reservoir 100. Note in FIG. 42 that front base plates 121, front corner plates 215, 216, 217 and rear plates 137 have been placed to form one corner of a rectangular or square reservoir 100 such shape as is shown in FIG. 1. Laterally extending front connectors 206 connect and laterally restrain each pair of front plates 120 or 121 similarly, laterally extending connectors 206 connect and laterally restrain rear plates 136 or 137. Each front corner plate 215, 216 joins to one or more front corner mid plates 216. In FIG. 42, there are three corner mid plates 217, to which are connected front corner plates 215, 217 as shown. Each corner plate 215, 216, 217 provides interlocking edge portions that interlock to perfect such connection as seen in FIG. 42. Plate 217 has interlocking edge portions 221, 222, plate 215 has interlocking edge portion 223. Plate 216 has interlocking edge portion 224. Edge 221 and edge 224 are able to connect. Edge 222 and edge 223 are able to connect.

Front base plates 120 or 121 have vertically extending pins 212 that form a connection with a slot or sleeve 209 or 210 in plate 207 or 208 of horizontally extending link 206. Similarly, horizontally extending link 200 has plates 201, 202 at opposing ends of bar 203. Each plate 201, 202 has a slot. Plate 201 has slot 204. Plate 202 has slot 205. The rear base plates 136, 137 have pins 213. Each horizontally extending link 200 connects with two rear plates 136 or 137 by placement of a slot 204 or 205 of plate 201 or 202 over a pin 213 of rear plate 136 or 137 (see FIGS. 46-56).

Each pin 212, 213 can provide a horizontally extending opening 214 that is receptive of a bolt, bolted connection, locking pin, cotter pin, lynch pin or other pin. Each plate 120, 121 or 136, 137 can provide vertical openings that are receptive of anchor pins, spikes or the like for anchoring the plate 120-121 or 136, 137 to the earth.

As discussed above FIGS. 36, 39, and 44 illustrate the capacity to place or layout a plurality of the various base members in advance and without having to erect the strut members 112, 112' or base members 122, 122' or support members 130, 130'.

FIG. 36 is an enlarged perspective view of the connections made between rear support plates 137 and horizontally extending links 200 for the straight strut assembly 110 of FIG. 19. FIG. 39 is an enlarged perspective view of the connections made between rear support plates 136 and horizontally extending links 200' for the corner strut assembly 150 of FIG. 28. FIG. 44 is an enlarged perspective view of the connections made between rear support plates 136,137 and horizontally extending links 200,200' for both the straight strut 110 assembly of FIG. 19 and the corner strut 150 assembly of FIG. 28, along with the connections made between front support plates 121 and horizontally extending members 200 for both the straight strut assembly 110 FIG. 19 and the corner strut 150 assembly of FIG. 28.

FIG. 33 is a perspective view of a horizontally extending link 200 which can be used in the straight strut assembly 110 of FIG. 19. It comprises bar 203 with plates 202 and 202, with each plate respectively including a slot 204, 205. FIG. 38 is a perspective view of a horizontally extending link 200' which can be used in the corner strut assembly 150 of FIG. 28. Link 200' comprises bar 203' with plates 202' and 204', with each plate respectively including a slot 204', 205'. One difference between link 200 and 200' is the spacing between the slots 204',205' from bar 203' is greater than the spacing of between the slots 204',205' from bar 203'. Such larger spacing allows links 200 to be placed in anon-parallel configuration such as needed in a corner strut assembly 150 (see e.g., FIG. 44).

FIG. 37 is a side view of a exemplary strut member 112. On lower end is included a sleeve 209 with open area 700. Also included on the lower end 114 is provided a recessed area 600. Such recessed area 600 will lock and/or contain particular plate or plates 201,201',202,202' on which such strut member 112 is placed over. FIG. 34 shows some example locking of plates 201,202 with recesses 600. In this manner links 200, 200' can be locked into place notwithstanding the fact that they include open slots 204,204', 205, 205'. During assembly, sleeve 209 can be inserted onto a selected pin of a base plate resting on top of the particular plate or plates of links 200,200' which were previously placed on the pin. The top of the pin will extend to the open area 700 and a locking pin 212 can be inserted into a hole of the pin thereby locking together the assembly (See FIG. 25). As another example, of the locking type of assembly, FIG. 24 is an enlarged perspective view of the lower locking connection between the rear support plate 137, the upper 132 and lower 122 support members, and horizontally extending links 200 for the strut assembly 110 of FIG. 19. In this case the upper support member 130 includes the locking recess 133 and sleeve 131 and locking pin 213 locks in place the assembly.

The following is a list of reference numerals used in this application:

LIST OF REFERENCE NUMERALS:

| REFERENCE NUMBER | DESCRIPTION |
|---|---|
| 100 | closed loop containment system/portable reservoir |
| 102 | arrangement |
| 104 | arrangement |
| 110 | straight strut assembly |
| 110' | straight strut assembly |
| 112 | strut member |
| 112' | strut member |
| 114 | first end |
| 115 | joint |
| 116 | second end |
| 116' | second end |
| 118 | coupling member |
| 119 | intermediate coupler |
| 120 | front base plate |
| 121 | front base plate |
| 122 | base member |
| 122' | base member |
| 124 | first end |
| 126 | second end |
| 130 | support member |
| 130' | support member |
| 131 | sleeve |
| 132 | first end |
| 133 | recess |
| 134 | second end |
| 134' | second end |
| 136 | rear base plate |
| 136' | rear base plate |
| 137 | rear base plate |
| 138 | rear plate |
| 139 | end coupling member |
| 140 | rear coupling |
| 140' | front coupling |
| 142 | bar |
| 142' | bar |
| 144 | angled receiving member |
| 144' | angled receiving member |
| 150 | corner strut assembly |
| 152 | strut member |
| 153 | sleeve |
| 154 | first end |

-continued

LIST OF REFERENCE NUMERALS:

| REFERENCE NUMBER | DESCRIPTION |
|---|---|
| 155 | recess |
| 156 | free second end |
| 156' | free second end |
| 157 | tapered region |
| 158 | coupling member |
| 158' | coupling member |
| 159 | intermediate coupling member |
| 161 | adjustable connecting member |
| 162 | base member |
| 164 | first end |
| 165 | point |
| 166 | second end |
| 170 | support member |
| 172 | first end |
| 174 | second end |
| 176 | rear base plate |
| 180 | rear coupling |
| 181 | rear coupling |
| 182 | bar |
| 182' | bar |
| 184 | angled receiving member |
| 184' | angled receiving member |
| 185 | sleeve |
| 186 | recessed area |
| 199 | water-impermeable liner |
| 200 | horizontally extending link |
| 201 | plate |
| 202 | plate |
| 203 | bar |
| 204 | slot |
| 205 | slot |
| 206 | horizontally extending link |
| 207 | plate |
| 208 | plate |
| 209 | sleeve |
| 210 | sleeve |
| 211 | opening |
| 212 | pin |
| 213 | pin |
| 214 | pin horizontal opening |
| 215 | front corner plate |
| 216 | front corner plate |
| 217 | front corner mid plate |
| 218 | vertical opening |
| 219 | cleat |
| 220 | retainer pin |
| 221 | interlocking edge portion |
| 222 | interlocking edge portion |
| 223 | interlocking edge portion |
| 224 | interlocking edge portion |
| 510 | v-shaped strut assembly |
| 510' | v-shaped strut assembly |
| 520 | right front base plate |
| 520' | left front base plate |
| 520" | center front base plate |
| 521" | pin |
| 600 | recessed area |
| 700 | open area |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A temporary liquid reservoir apparatus, comprising:

a) a frame structure that supports a flexible liner to contain a body of water on a ground surface, the frame structure having a top, a bottom, a plurality of sides and multiple corners that surround an enclosed ground surface, the frame structure including multiple straight frame structures defining the plurality of sides, and multiple curved frame structures defining the multiple corners, wherein the flexible liner extends down from the top and over the enclosed ground surface;

b) each straight and curved frame structure including multiple inclined beams being removably connectable to each other and to laterally extending connectors that maintain lateral spacing between the straight and curved frame structures, the frame structures being collapsible between an erected position and a collapsed position;

c) each straight frame structure including a plurality of inclined beam members that form a pattern of alternating V and inverted V shapes;

d) a plurality of base plates that are adapted to support the bottom of the inclined beam members on a supporting surface, each base plates including a plurality of front, inner base plates and a plurality of outer rear base plates each outer base plate having one or more vertically extending pins;

e) diagonal supports that span between one of the outer base plates and one of the inclined beam members;

f) each inner base plate supporting two of said beams that form the bottom of a V shaped strut assembly;

g) connections that join each inclined beam member to one of the inner base plates; and h) lateral connectors including lower connectors that each span between two adjacent of the outer base plates, the connector having end portions that each connect with a pin of one of the outer base plates, in which the base plate has at least two spaced apart projections disposed therein for connection to a beam.

2. The temporary liquid reservoir apparatus of claim 1, wherein each lateral connector has slotted plates at opposing end portions, each slotted plate being receptive of one of the pins.

3. The temporary liquid reservoir apparatus of claim 1, further comprising an upper connector that connects between two adjacent beams at upper end portions of the beams.

4. The temporary liquid reservoir apparatus of claim 1, wherein the front, inner base plates have one or more vertically extending pins and each lower connector includes end portions with slotted plates that connect with the pins of the inner base plates.

5. The temporary liquid reservoir apparatus of claim 1, wherein a pair of the beams forms one of the V-shaped strut assemblies wherein the beams form an angle of between 10 and 90 degrees.

6. The temporary liquid reservoir apparatus of claim 1, wherein the laterally extending connectors include inner, lower connectors that each span between a pair of inner base plates.

7. The temporary liquid reservoir apparatus of claim 1, in which each of the base plates comprises a flat planar base support member and attachment bracket for connecting between one of the beams and one of the base plates.

8. A temporary liquid reservoir comprising:

a) a plurality of frame structures supporting a flexible web liner, each of said frame structures including multiple inclined beams, at least one brace beam, and a base plate;

b) said inclined and brace beams being removably connectable to each other in an erected position to form said frame structure, at least two of said inclined beams of said erected frame structure lying in a common plane, said frame structure being collapsible between said erected position and a collapsed position; and c) each base plate connected to a bottom of said frame structure, said base plates being adapted for connection at any position along said bottom of said frame structure, each said base plate being adapted to support said frame structure on a supporting surface; and d) the base plates being linked together with front lateral connectors and rear lateral connectors that define with the base plates a reservoir shape before the inclined and brace beams are added to the base plates.

9. The structure of claim 8, in which each of said base plates comprises a flat planar base support member and attachment bracket for connecting to an inclined beam.

10. The structure of claim 9, in which said base plate member has at least one projection therein for connecting with a said lateral connector.

11. The structure of claim 8, wherein there are multiple points of connection between said beams, enabling said frame structure to fold down into said collapsed position.

12. A method of constructing a portable reservoir, comprising the steps of:

a) placing a plurality of base plates on an underlying support surface, said plurality of base plates including inner base plates and outer base plates;

b) maintaining a lateral spacing of each base plate relative to the other base plates with connector bars that each have end portions;

c) forming a removable connection with each connector bar end portion and a said base plate;

d) wherein steps “a”, “b” and “c” define a reservoir footprint;

e) erecting a straight strut arrangement that comprises a plurality of straight strut assemblies, each straight strut assembly including a plurality of inner base plates that enable interface of each straight strut assembly with a ground surface, a plurality of inclined beams, each having a lower surface that is attached to and bears upon a said inner base plate, a plurality of outer base plates, and intermediate beams that each extend between an outer base plate and an inclined beam, each intermediate beam connecting to the inclined beam at a position in between the ends of the inclined beam, the inclined beams forming an alternating v-shaped and inverted v-shaped pattern;

f) erecting a curved strut arrangement comprising a plurality of corner strut assemblies forming a desired curvature and connecting two straight strut arrangements to form a closed loop water containment system; and g) maintaining a lateral spacing between the inclined beams with lateral bracing.

13. The method of claim 12, wherein each connector bar connects to a plate with a pin and slot connection.

14. The method of claim 12, wherein each plate has projections and each connector bar has slotted end portions, and further comprising the step of engaging a said projection with a said slot.

15. The method of claim 12, further comprising the step of connecting an upper connector between two adjacent beams at upper end portions of the beams.

16. The method of claim 12, wherein in step "e" and "f" the beams are adapted to collapse to a folded position.

17. The method of claim 12, further comprising forming an angle of between 10 and 90 degrees for said V shaped pattern.

18. The method of claim 12, wherein the laterally extending connectors include inner, lower connectors and further comprising spanning each lower connector between a pair of inner base plates.

19. The method of claim 12, in which each of the base plates comprises a flat planar base support member and attachment bracket and further comprising connecting between one of the beams and one of the base plate brackets.

20. A temporary liquid reservoir comprising:

a) a plurality of frame structures supporting a flexible web liner, each of said frame structures including multiple inclined beams, at least one brace beam, and a base plate;

b) said inclined and brace beams being removably connectable to each other in an erected position to form each said frame structure, each said frame structure being collapsible between said erected position and a collapsed position;

c) each base plate connected to a bottom of said frame structure, said base plates being adapted for connection at any position along said bottom of said frame structure, each said base plate being adapted to support said frame structure on an underlying supporting surface;

d) the base plates being linked together with lateral connectors that define with the base plates a reservoir shape before the inclined and brace beams are added to the base plates; and e) wherein the inclined beams form alternating V and inverted V shapes.

21. The structure of claim 20, wherein the laterally extending connectors include inner, lower connectors that each span between a pair of inner base plates.

22. The structure of claim 20, wherein the laterally extending connectors include outer, lower connectors that each span between a pair of outer base plates.

23. The structure of claim 20, wherein there are multiple points of connection between said beams, enabling said frame structure to fold down into said collapsed position.

24. A method of constructing a portable reservoir, comprising the steps of:

a) placing a plurality of base plates on an underlying support surface, said plurality of base plates;

b) maintaining a lateral spacing of each base plate relative to the other base plates with connector bars that each have end portions;

c) forming a removable connection with each connector bar end portion and each said base plate;

d) wherein steps "a", "b" and "c" define a reservoir footprint;

e) erecting a straight strut arrangement that comprises a plurality of straight strut assemblies, each straight strut assembly including a plurality of base plates that enable interface of each straight strut assembly with a ground surface, a plurality of inclined beams, each having a lower surface that is attached to and bears upon each said base plate, intermediate beams that each extend between a base plate and an inclined beam, each intermediate beam connecting to the inclined beam at a position in between the ends of the inclined beam;

f) wherein the inclined beams form an alternating v-shaped and inverted v-shaped pattern;

g) erecting a curved strut arrangement comprising a plurality of corner strut assemblies forming a desired curvature and connecting two straight strut arrangements to form a closed loop water containment system; and h) maintaining a lateral spacing between the inclined beams.

25. The method of claim 24, wherein each connector bar connects to a plate with a pin and slot connection.

26. The method of claim 24, wherein each plate has projections and each connector bar has slotted end portions, and further comprising the step of engaging a said projection with a said slot.

27. The method of claim 24, further comprising the step of connecting an upper connector between two adjacent beams at upper end portions of the beams.

28. The method of claim 24, wherein in step "e" and "f" the beams are adapted to collapse to a folded position.

29. The method of claim 24, further comprising forming an angle of between 10 and 90 degrees for said V shaped pattern.

30. The method of claim 24, in which each of the base plates comprises a flat planar base support member and an attachment bracket and further comprising the step of connecting between one of the beams and one of the base plate attachment brackets.

* * * * *